US008542178B2

(12) United States Patent
Yoo et al.

(10) Patent No.: US 8,542,178 B2
(45) Date of Patent: Sep. 24, 2013

(54) DISPLAY DRIVING CIRCUIT GATE DRIVER WITH SHIFT REGISTER STAGES

(75) Inventors: Se Jong Yoo, Icheon-Si (KR); Ki Min Son, Icheon-Si (KR); Joon Sung An, Seoul (KR); Seong Jun An, Icheon-Si (KR)

(73) Assignee: Hydis Technologies Co., Ltd., Icheon-Si (KR)

( * ) Notice: Subject to any disclaimer, the term of this patent is extended or adjusted under 35 U.S.C. 154(b) by 530 days.

(21) Appl. No.: 12/815,942

(22) Filed: Jun. 15, 2010

(65) Prior Publication Data

US 2011/0298771 A1 Dec. 8, 2011

(30) Foreign Application Priority Data

Jun. 3, 2010 (KR) ..... 10-2010-0052240

(51) Int. Cl.
*G09G 3/36* (2006.01)

(52) U.S. Cl.
USPC ..... 345/100; 377/64

(58) Field of Classification Search
USPC ..... 345/100, 211; 377/64
See application file for complete search history.

(56) References Cited

U.S. PATENT DOCUMENTS

| | | | | |
|---|---|---|---|---|
| 5,517,542 | A * | 5/1996 | Huq | 377/78 |
| 2005/0156858 | A1 | 7/2005 | Ahn et al. | |
| 2007/0176641 | A1* | 8/2007 | Kursun et al. | 326/97 |
| 2010/0171728 | A1* | 7/2010 | Han et al. | 345/211 |

FOREIGN PATENT DOCUMENTS

| | | | |
|---|---|---|---|
| KR | 1020070011953 | A | 1/2007 |
| KR | 100705628 | B1 | 4/2007 |
| KR | 1020050070554 | B1 | 4/2007 |
| KR | 1020100070627 | A | 6/2010 |

* cited by examiner

*Primary Examiner* — Allison Walthall
(74) *Attorney, Agent, or Firm* — The Webb Law Firm

(57) ABSTRACT

A display driving circuit is provided. The display driving circuit, in which a gate driver shifting and outputting an input signal is embedded, includes an input portion receiving a pulse input signal consisting of a high-level signal and a low-level signal and transferring the pulse input signal to a boosting node, an inverter portion connected with the input portion, and inverting the pulse input signal to output the inverted signal, and a pull-up/pull-down portion consisting of a pull-up portion connected to the input portion, receiving a boosting voltage from the boosting node, and outputting a pull-up output signal, and a pull-down portion connected to the inverter portion, receiving the inverted signal, and outputting a pull-down output signal. Here, the inverter portion outputs a signal having a lower level than the low-level signal for a predetermined time period in which the pull-up output signal is output. Accordingly, the display driving circuit exhibits excellent output characteristics due to improved performance and also has excellent reliability.

12 Claims, 21 Drawing Sheets

PRIOR ART

PRIOR ART

PRIOR ART

PRIOR ART (A) CASE OF USING (N-1)TH INPUT SIGNAL (B) CASE OF USING (N-2)TH INPUT SIGNAL (A) CASE OF USING (N-1)TH INPUT SIGNAL (B) CASE OF USING (N-2)TH INPUT SIGNAL (A) P NODE WAVEFORM OF FIRST AND SECOND BLOCKS (B) X NODE WAVEFORM OF FIRST AND SECOND BLOCKS (A) OUTPUT WAVEFORM OF FIRST EXEMPLARY EMBODIMENT OF PRESENT INVENTION (B) OUTPUT WAVEFORM OF SECOND EXEMPLARY EMBODIMENT OF PRESENT INVENTION

DISPLAY DRIVING CIRCUIT GATE DRIVER WITH SHIFT REGISTER STAGES

CROSS-REFERENCE TO RELATED APPLICATION

This application claims priority to and the benefit of Korean Patent Application No. 2010-52240, filed Jun. 3, 2010, the disclosure of which is incorporated herein by reference in its entirety.

BACKGROUND

1. Field of the Invention

The present invention relates to a display driving circuit, and more particularly, to a display driving circuit which exhibits excellent output characteristics due to improved performance and has excellent reliability.

2. Discussion of Related Art

In general, it is difficult to diversely integrate circuits for driving pixels in a liquid crystal display (LCD) panel employing amorphous silicon (a-Si) thin-film transistors (TFTs) due to low mobility, unlike an LCD panel employing low-temperature polysilicon TFTs.

To solve this problem, active attempts to integrate regions capable of operating at a low frequency in a panel have been made lately. Among the attempts, integrating a gate driver circuit in a panel is considered the most efficient technique, and also the resultant product has been put on the market. Multiple LCD driving circuits in which a gate driver circuit is integrated according to conventional art are disclosed in Korean Patent Registration No. 705628 filed by the present Applicant, and so on.

To overcome low mobility, a gate driver circuit integrated in an LCD panel increases the width of a TFT and forms a shift register circuit using a bootstrap effect.

FIG. 1 is a block diagram of a shift register circuit using a general bootstrap effect. A shift register circuit using a bootstrap effect may use 2-phase driving or 4-phase driving. In 2-phase driving, a clock signal used for synchronization of a shift register operation and current supply is synchronized with one horizontal time, which corresponds to the high-level section of a gate pulse, and two clock signals having a phase difference of 180° are used. In 4-phase driving, a clock signal used for synchronization of a shift register operation and current supply is synchronized with one horizontal time, like 2-phase driving, but four clock signals having a phase difference of 90° are used, that is, a clock signal whose high-level section is repeated every four horizontal times is used.

FIG. 2(A) shows waveforms of a shift register using 2-phase driving, and FIG. 2(B) shows waveforms of a shift register using 4-phase driving.

Referring to FIGS. 1 and 2, a previous-stage output (generally an (N−1)th or (N−2)th output) is input through an input portion 11, and then a TFT of the input portion 11 is switched to its off-state, so that a bootstrap node P-node becomes a floating node. Subsequently, when a clock signal is raised from a low-level voltage VGL to a high-level voltage VGH during a horizontal time, the bootstrap node P-node in the floating state is ideally raised to about double the high-level voltage VGH (generally 2 VGH−a) due to the coupling effect of the clock signal.

At this time, since the voltage raised by the bootstrap effect is applied to the gate node of an output TFT T11, large current can flow through the output TFT T11, and the clock signal is output to an output node without significant loss of a rise/fall delay time. A signal delay of one horizontal time occurs between the input signal and the output signal, and thus the shift register circuit can normally operate.

Next, Korean Patent Registration No. 705628 filed by the present Applicant will be described as an example of a driving circuit in which a gate driver circuit is embedded according to conventional art. FIG. 3 is a circuit diagram of an LCD driving circuit disclosed in Korean Patent Registration No. 705628.

Referring to FIG. 3, a conventional driving circuit includes eight TFTs T1 to T8, and two capacitors C1 and C2. The driving circuit of FIG. 3 includes a pull-up/pull-down circuit portion 130 having a pull-up portion T3 generating a gate high-level voltage, and pull-down portions T2 and T4 generating a gate low-level voltage. To implement a pull-down function, an output of n-type TFT (NTFT) inverter circuits T5 and T6 is used as a control signal.

An output signal X of the inverter circuits T5 and T6 is applied to the TFT gate nodes of the pull-down portions T2 and T4. At this time, an increase in gate voltage leads to improvement in circuit performance, but deteriorates the TFTs due to stress caused by gate node bias voltage, which results in deterioration of reliability. In general, when the TFTs of pull-down portions T2 and T4 are turned off, a gate-source voltage (Vgs) of the TFTs is frequently 0 V or more, and in this case, there is leakage current.

FIG. 4 shows graphs illustrating leakage current increasing when mobility increases or a threshold voltage Vth decreases according to current-voltage (I-V) characteristics of a TFT. As shown in FIG. 4, when the Vgs of a TFT is 0 V or more, an increase in mobility or a reduction in the threshold voltage Vth leads to an increase in leakage current according to I-V characteristics of the TFT, thereby deteriorating circuit performance.

Further, when the threshold voltage Vth is low and a mobility increasing factor, such as high temperature, occurs in the high-level section of an output of a gate driver integrated as a circuit leakage current component in the circuit of the pull-down portions T2 and T4, the output of the gate driver is attenuated and output.

SUMMARY OF THE INVENTION

The present invention is directed to providing a display driving circuit which exhibits excellent output characteristics due to improved performance and has excellent reliability.

One aspect of the present invention provides A display driving circuit, in which a gate driver including a plurality of shifter register stages for shifting and outputting an input signal is embedded, including: an input portion receiving a pulse input signal consisting of a high-level signal and a low-level signal and transferring the pulse input signal to a boosting node; an inverter portion connected with the input portion, and inverting the pulse input signal to output the inverted signal; and a pull-up/pull-down portion consisting of a pull-up portion connected to the input portion, receiving a boosting voltage from the boosting node, and outputting a pull-up output signal, and a pull-down portion connected to the inverter portion, receiving the inverted signal and outputting a pull-down output signal. Here, the inverter portion outputs a signal having a lower level than the low-level signal for a predetermined time period in which the pull-up output signal is high.

Here, the inverter portion may output an overshoot for a predetermined time period in which the pull-down output signal is output.

Another aspect of the present invention provides A display driving circuit, in which a gate driver including a plurality of shifter register stages for shifting and outputting an input signal is embedded, including first and second blocks. The first block includes: a first input portion receiving and transferring a pulse input signal consisting of a high-level signal and a low-level signal to a first boosting node; an inverter portion connected with the first input portion, and inverting the pulse input signal to output the inverted signal; and a first pull-up/pull-down portion consisting of a first pull-up portion connected to the first input portion, receiving a boosting voltage from the first boosting node, and outputting a first pull-up output signal, and a first pull-down portion connected to the inverter portion, receiving the inverted signal, and outputting a first pull-down output signal. The second block includes: a second input portion receiving and transferring an output signal of the first block to a second boosting node; and a second pull-up/pull-down portion consisting of a second pull-up portion receiving a boosting voltage from the second boosting node and outputting a second pull-up output signal and a second pull-down portion sharing the inverter portion to receive the inverted signal and output a second pull-down output signal. Here, the inverter portion outputs a signal having a lower level than the low-level signal for a predetermined time period in which the pull-up output signal is output.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which.

DETAILED DESCRIPTION OF EXEMPLARY EMBODIMENTS

Hereinafter, exemplary embodiments of the present invention will be described in detail. However, the present invention is not limited to the embodiments disclosed below, but can be implemented in various forms. The following embodiments are described in order to enable those of ordinary skill in the art to embody and practice the present invention.

Exemplary embodiments of the present invention can be applied to all kinds of Display apparatus which employ TFT (Thin Film Transistor) as switching device, for example, electronic paper displays or electrophoretic displays (EPDs) or general liquid crystal displays (LCDs) or AMOLED (Active Matrix Organic Light Emitting Diode) (e.g., LCDs employing an amorphous silicon (a-Si) thin-film transistor (TFT)).

Here, an EPD is a flat panel display that can be comfortably "read" without stress, like an e-book, e-paper, etc. The EPD is a non-self-light-emitting display based on an electrophoretic phenomenon, which influences charged particles suspended in a solvent.

Such an EPD generally includes one pair of separated substrates that face each other, and electrodes present in the pair of substrates respectively. Here, at least one of the electrodes is transparent. Also, an electrophoretic device is present between the pair of confronting substrates, and a dielectric solvent and charged particles distributed in the dielectric solvent are included in the electrophoretic device.

Thus, when different voltages are applied through the electrodes present in the substrates, charged particles move to a substrate having a polarity opposite to the charged polarity due to gravity. In this case, a color seen from the substrate including the transparent electrode is determined by the colors of the dielectric solvent and the charged particles, the arrangement of the charged particles in the dielectric solvent, and so on.

The EPD applies a selection signal and a data signal to a pixel region, in which a plurality of scanning lines and a plurality of data lines intersect, through the scanning lines and data lines respectively, so that a plurality of pixels can display an image in grayscale. In this case, the EPD has a transistor device to control a data signal applied to each pixel, and the transistor device generally consists of a TFT.

<First Exemplary Embodiment>

Figure 5:
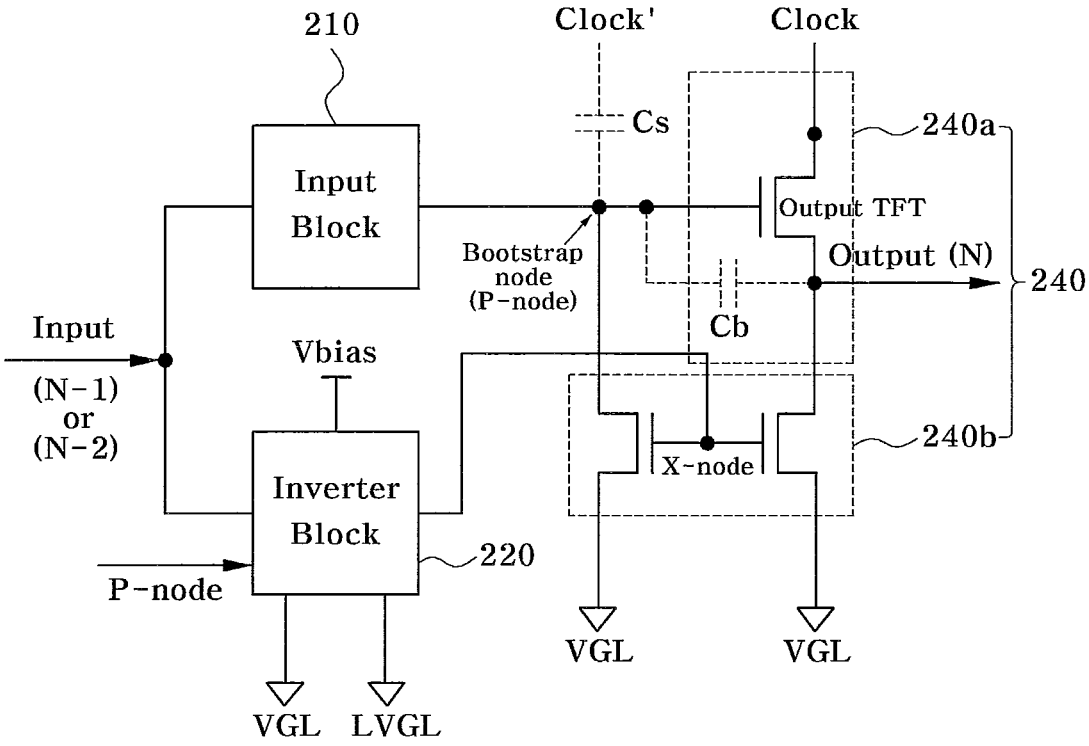
FIG. 5 is a block diagram of a display driving circuit according to a first exemplary embodiment of the present invention.

FIG. 5 is a block diagram of a display driving circuit according to a first exemplary embodiment of the present invention.

Referring to FIG. 5, the display driving circuit according to the first exemplary embodiment of the present invention includes an input portion 210, an inverter portion 220, and a pull-up/pull-down circuit portion 240.

Here, the input portion 210 receives and transfers a pulse input signal having a high level VGH and a low level VGL to a boosting node (bootstrap node) P-node, and the inverter portion 220 is connected with the input portion 210, inverts a pulse input signal, and outputs the inverted signal to an X-node.

The pull-up/pull-down circuit portion 240 includes a pull-up portion 240*a* that is connected to the input portion 210, receives a boosting voltage from the boosting node P-node and outputs a pull-up output signal, and a pull-down portion 240*b* that is connected to the inverter portion 220, receives the inverted signal and outputs a pull-down signal.

Here, the inverter portion 220 outputs a signal having a lower level LVGL than the low level VGL of the pulse input signal input to the input portion 210 for a predetermined time period in which the pull-up output signal is output. An LVGL voltage may be lower than a VGL voltage by about 3 V to 6 V.

The input portion 210 may have an input switch in the form of a diode using a saturation mode TFT. A signal input is applied when the input signal is in the high level VGH, and is interrupted when the input signal is in the low level VGL. After a signal is input, the input portion 210 functions to maintain a floating state.

The pull-up portion 240*a* uses a clock signal as a power source for generating a high-level voltage of a gate output waveform. The voltage level of the clock signal has a high or low level of a gate driving voltage, that is, one of the two levels VGH and VGL. The duty ratio of a clock waveform is about 20% to 50%, and a 2-phase signal or 4-phase signal can be used according to a driving method as mentioned above.

Figure 6:
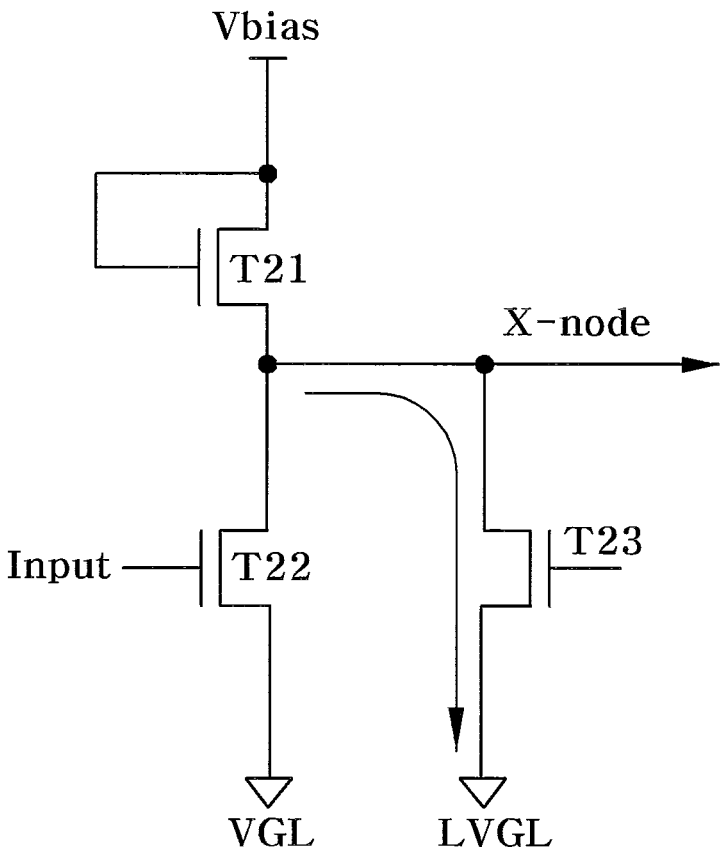
FIG. 6 is a circuit diagram of an inverter portion of FIG. 5.
Figure 7:
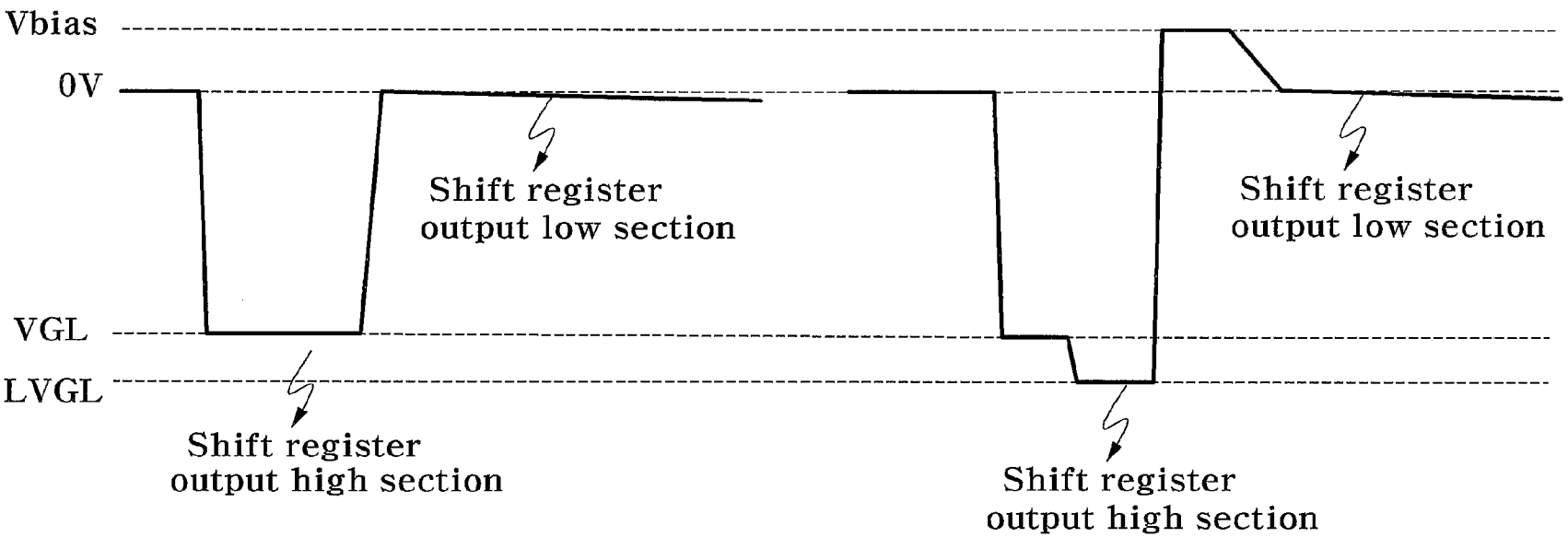
FIG. 7 shows graphs illustrating an output waveform output from the inverter portion of FIG. 6 in comparison with an output waveform according to conventional art.

FIG. 6 is a circuit diagram of the inverter portion 220 of FIG. 5, and FIG. 7 shows graphs illustrating an output waveform output in comparison with an output waveform according to conventional art. A left graph of FIG. 7 shows an output waveform according to conventional art, and a right graph of FIG. 7 shows an output waveform according to an exemplary embodiment of the present invention.

Referring to FIG. 6, the inverter portion 220 has TFTs T21, T22 and T23, receives a bias voltage Vbias and an input signal Input, and a signal of the bootstrap node P-node as inputs, and transfers an output signal to the X-node.

The exemplary embodiment is different from conventional art in that the TFT T23 is added. The gate terminal of the TFT T23 is connected to the bootstrap node P-node, and the source terminal is connected to the lower level LVGL than the voltage level VGL of the source terminal. Also, the voltage Vbias to which the drain of the TFT T21 is connected is set to have a voltage level (about 4 V to 5 V) so that the TFT T21 for maintaining an X-node output signal at an off level can have an appropriate voltage level for normal operation.

Unlike an inverter circuit outputting the voltage level VGL using only an input voltage as a control signal according to conventional art, the inverter portion 220 uses the bootstrap node P-node as a control signal. The inverter portion 220 causes the output of the inverter circuit to have lower electric potential than the voltage level VGL using the lower VGL (LVGL) signal, and causes gate-source voltages (Vgs) of TFTs in a pull-down function portion to be negative numbers to reduce leakage current, thereby removing a circuit destabilizing factor such as high temperature and reduction in a threshold voltage Vth.

Figure 8:
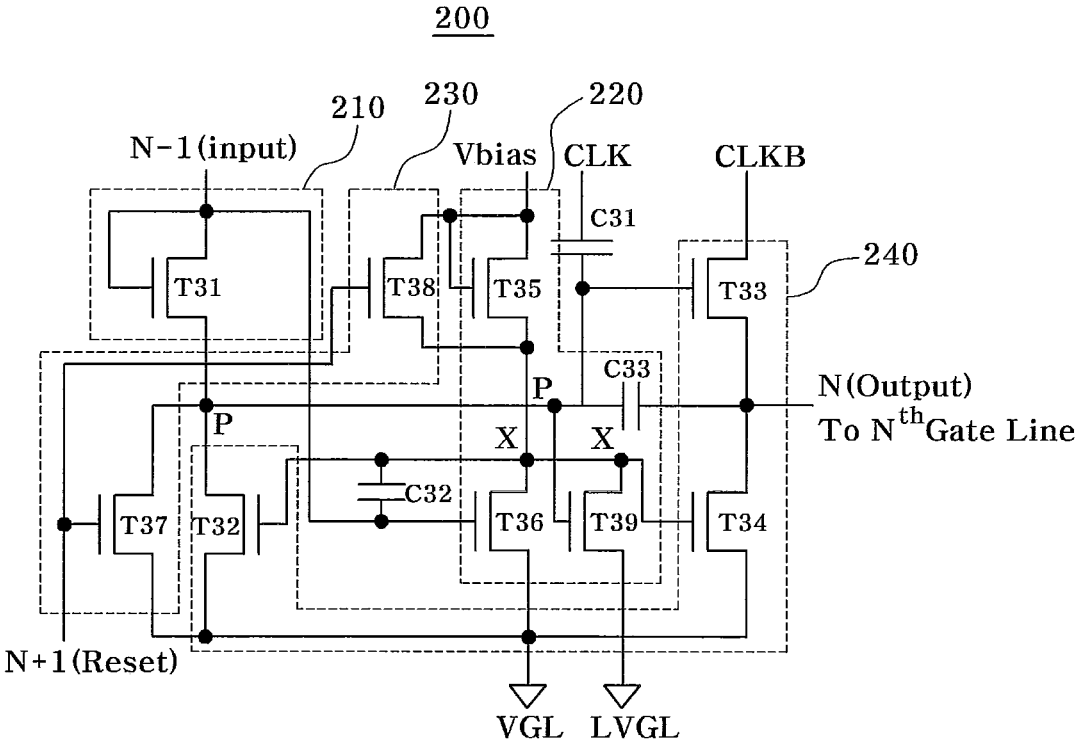
FIG. 8 is a circuit diagram of a display driving circuit according to a first exemplary embodiment of the present invention.

FIG. 8 is a circuit diagram of a display driving circuit according to a first exemplary embodiment of the present invention. FIG. 8 only shows fundamental TFTs and capacitances, in which a not-shown circuit portion may be present, and portions unnecessary to describe the spirit of the present invention are omitted. As an example, the display driving circuit of FIG. 8 includes nine TFTs and two capacitors. The sizes of the respective TFTs may differ from each other, and an additional component may be included.

The display driving circuit of FIG. 8 includes TFTs T31, T32, T33, T34, T35, T36, T37, T38 and T39, and two capacitors C31 and C32.

Here, the drain terminal and gate terminal of the first transistor T31 are connected in common to an output terminal of an (N−1)th or (N−2)th gate line.

The drain terminal of the second transistor T32 is connected with the source terminal of the first transistor T31 to form a P-node P, and the source terminal is connected to a VGL terminal.

A clock signal CLK is applied to the first electrode of the first capacitor C31, and the second electrode is connected to the P-node P.

The gate terminal of the third transistor T33 is connected to the P-node P, an inverted signal CLKB of the clock signal CLK is applied to the drain terminal, and the source terminal is connected to an N-th gate line.

The gate terminal of the fourth transistor T34 is connected with the gate terminal of the second transistor T32 to form an X-node, the drain terminal is connected to the N-th gate line, and the source terminal is connected to the VGL terminal.

The gate terminal and drain terminal of the fifth transistor T35 are connected in common to a Vbias terminal, and the source terminal is connected to the X-node.

The sixth transistor T36 is connected between the X-node and the VGL terminal, and the gate terminal is connected to the drain terminal of the first transistor T31.

The second capacitor C32 is connected between the X-node and the gate terminal of the sixth transistor T36.

Figure 1:
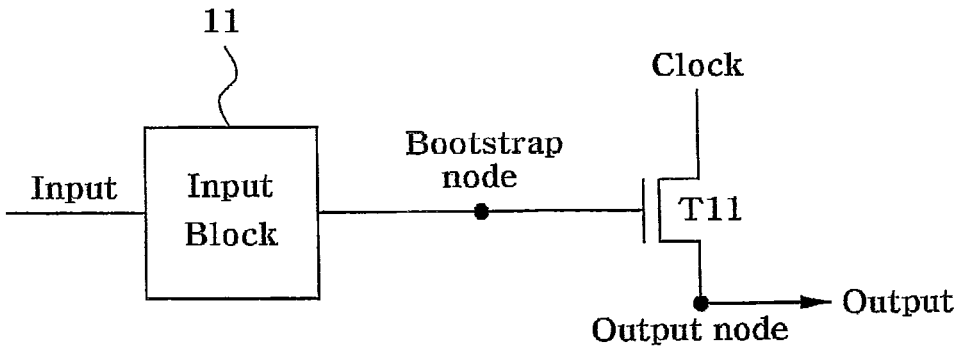
FIG. 1 is a block diagram of a shift register circuit using a general bootstrap effect.
Figure 2:
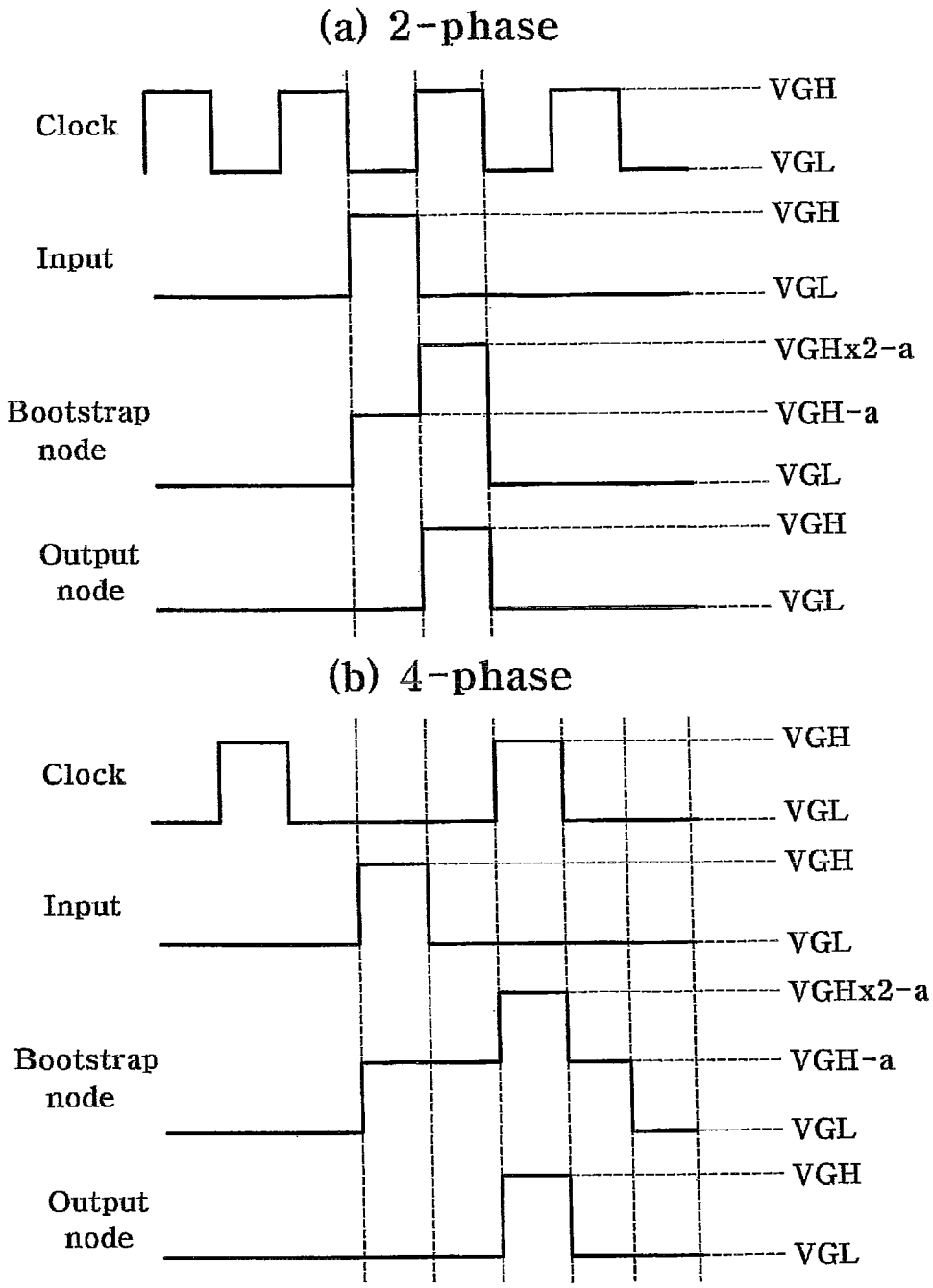
FIGS. 2(A) and 2(B) show waveforms of a shift register using 2-phase driving and 4-phase driving.
Figure 3:
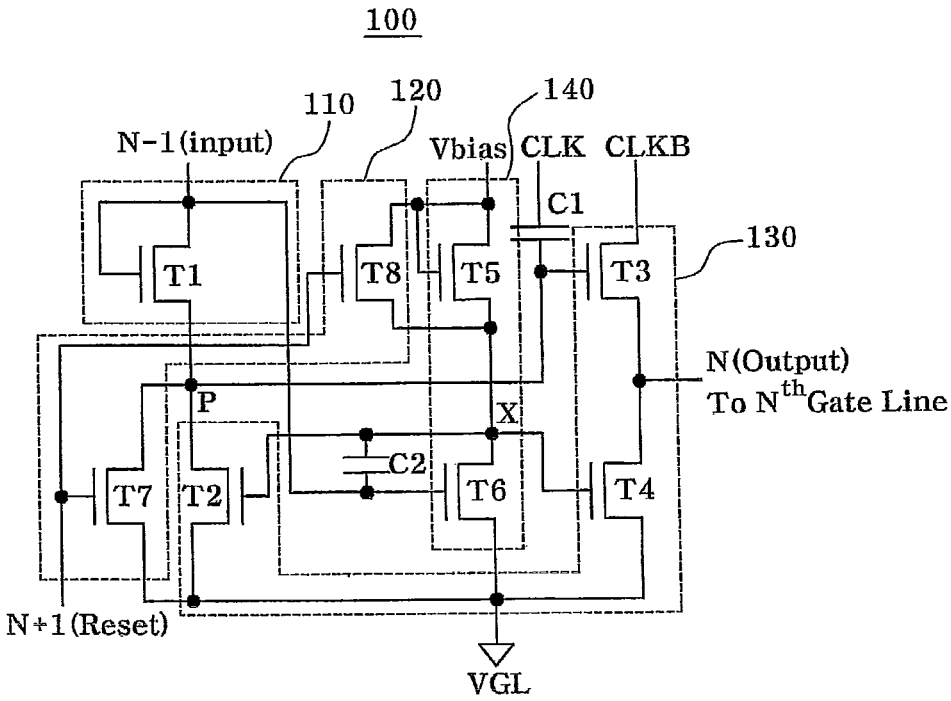
FIG. 3 is a circuit diagram of a liquid crystal display (LCD) driving circuit disclosed in Korean Patent Registration No. 705628.
Figure 4:
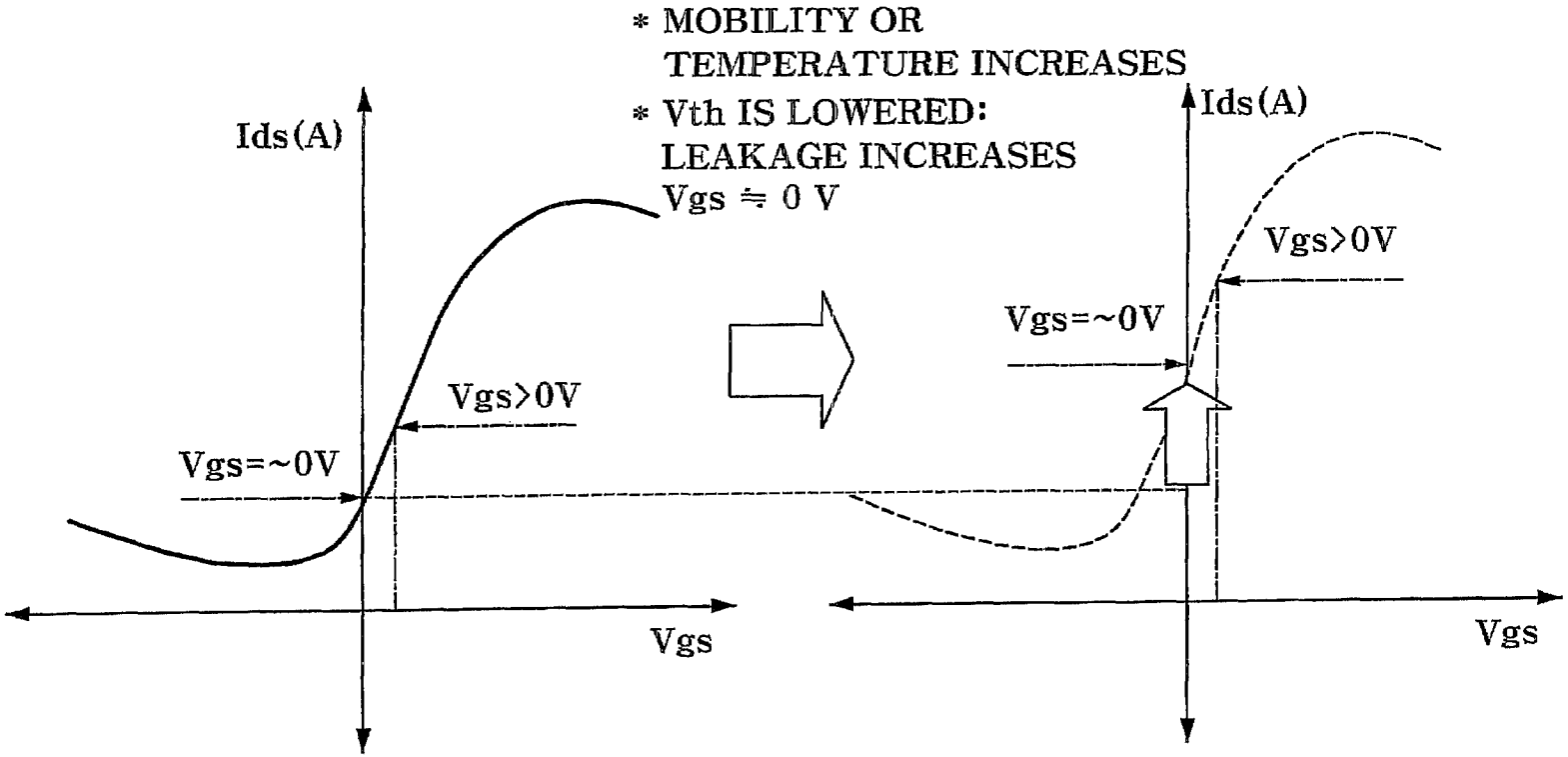
FIG. 4 shows graphs illustrating leakage current increasing when mobility increases or a threshold voltage decreases according to current-voltage (I-V) characteristics of a thin-film transistor (TFT)

The display driving circuit of FIG. 8 is essentially different from the driving circuit of FIG. 3 according to conventional art in that a ninth TFT T39 is included in an inverter portion 240. The gate terminal of the ninth transistor T39 is connected to the P-node P, the drain terminal is connected to the X-node, and the source terminal is connected to an LVGL terminal having a lower voltage level than a VGL terminal.

Also, the seventh transistor T37 and the eighth transistor T38 may be added for a reset function. The gate terminal of the seventh transistor T37 is connected to an (N+1)th gate line, and the seventh transistor T37 is connected between the P-node P and the VGL terminal in parallel with the second transistor T32. The gate terminal of the eighth transistor T38 is connected to the (N+1)th gate line, and the eighth transistor T38 is connected between the Vbias terminal and the X-node.

Figure 9A:
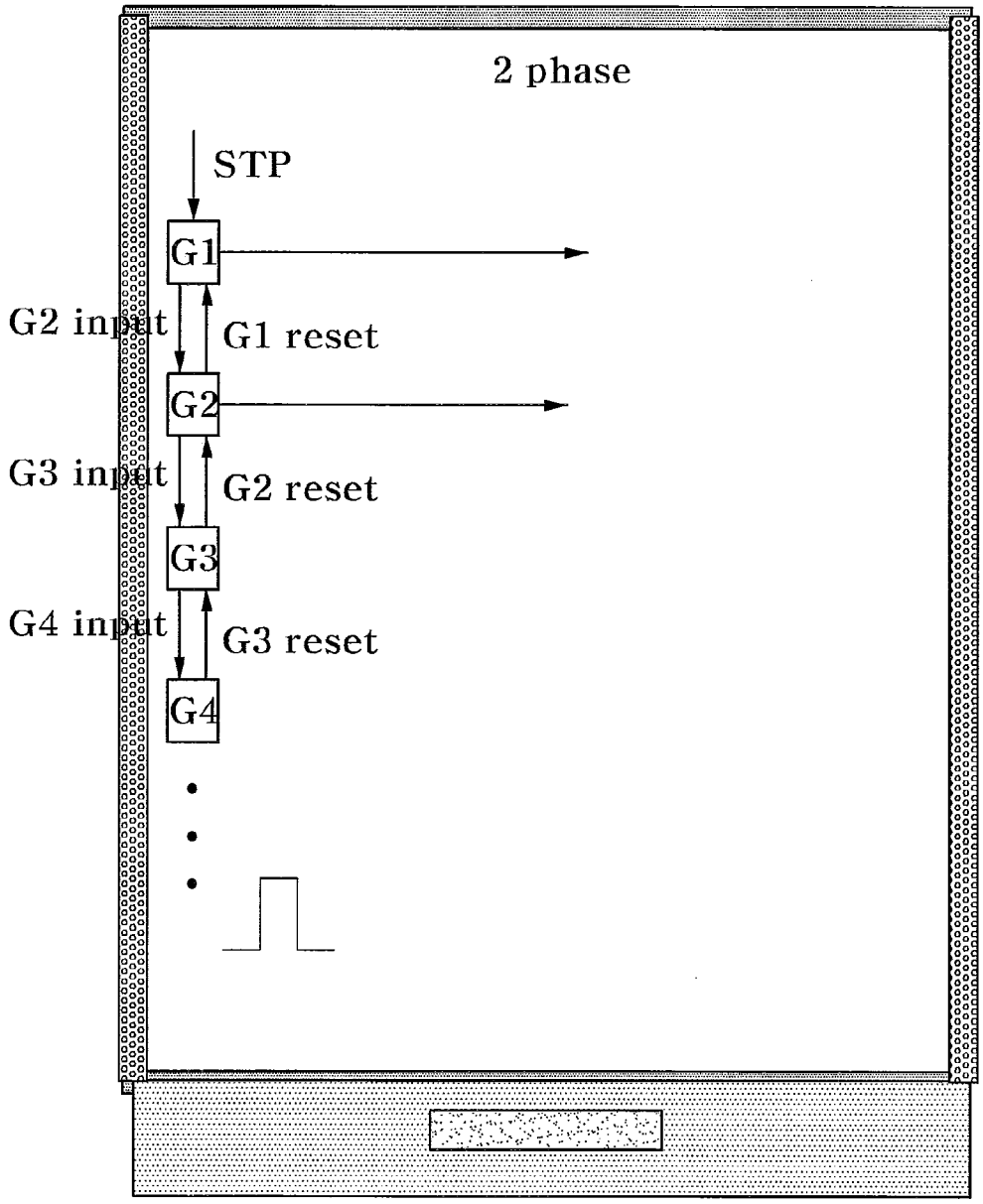
FIG. 9A illustrates a case in which the display driving circuits according to the first exemplary embodiment of the present invention are disposed on only one side of a substrate.
Figure 9B:
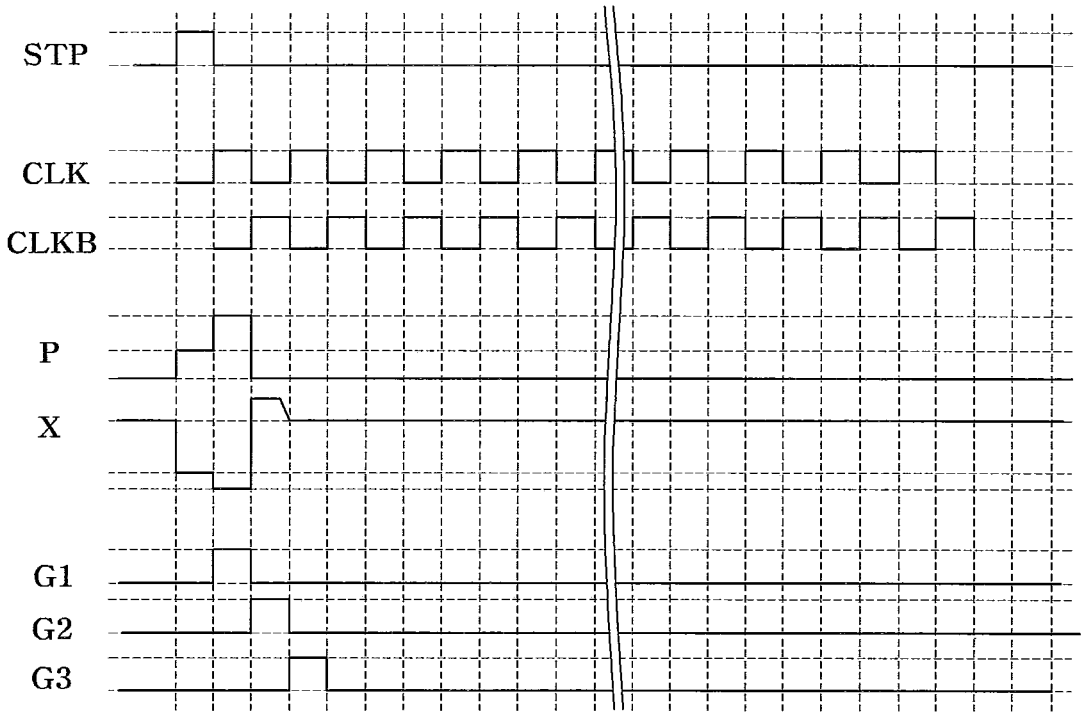
FIG. 9B is a timing diagram of FIG. 9A.

FIG. 9A illustrates a case in which the display driving circuits according to the first exemplary embodiment of the present invention are disposed on only one side of a substrate, and FIG. 9B is a timing diagram of FIG. 9A.

The disposition of FIG. 9A is used for 2-phase driving. For 4-phase driving, the display driving circuits are separately disposed (odd and even) on two sides of a substrate (see FIG. 10). Inputs and reset timings of the two cases may differ from each other according to exemplary embodiments.

Referring to FIGS. 9A and 9B, a G1 block, a G2 block, a G3 block, . . . are disposed in sequence on one side of a substrate.

Referring to FIGS. 8, 9A and 9B, a start pulse (STP) signal is input to N−1(input), and the P-node P and the X-node X perform 2-phase driving by the clock signal CLK and the inverted clock signal CLKB as illustrated in the timing diagram.

For convenience, only states of the P-node and the X-node at the G1 block are illustrated in the timing diagram. Thus, timings of the P-node and the X-node are shifted by one period per block at the following blocks such as the second block and the third block.

Operation of the display driving circuit constituted as described above will be described in detail below.

Referring to FIG. 8, the circuit operates as follows: First, an output signal N−1 (input) of an (N−1)th circuit (not shown) is input through the drain terminal of the first transistor T31.

When the output signal of the (N−1)th circuit, which is an input signal from the viewpoint of an N-th circuit that is the driving circuit, is input through the first transistor T31, the clock signal CLK is also input in synchronization with the input signal.

When the input signal is in the high level VGH, the first transistor T31 and the sixth transistor T36 are turned on, the P-node has a positive level, and a voltage becomes an electric potential (VGH−a) calculated by subtracting the threshold voltage of the first transistor T31 from a voltage of the high level VGH.

Meanwhile, an output signal is maintained at the low level VGL because the X-node has the high level VGH and the third transistor T33 is kept turned off. The second capacitor C32 is charged.

Here, the input signal is switched to the low level VGL, the first transistor T31 and the sixth transistor T36 are turned off, the third transistor T33 is turned on by a voltage of the high-level VGH of the P-node, the inverted clock signal CLKB is at the high level VGH, and thus the output signal is in the high level VGH.

Meanwhile, the gate terminal of the ninth transistor T39 is connected to the P-node, and the source terminal is connected to the lower voltage level LVGL than the low level VGL. Due to such a constitution, the X-node can have a profile as shown in FIG. 9B.

When the output signal of an (N+1)th circuit is applied as a reset signal to the seventh transistor T37 and the eighth transistor T38, the P-node has a low level, and the X-node has high voltage due to the fifth transistor T35. Thus, the second transistor T32 and the fourth transistor T34 can be kept turned on, and it is possible to maintain the off voltage of an output waveform.

Here, a capacitance Cap of the second capacitor C32 is intended to maintain and stabilize an electric potential level at the X-node, and the capacitance of the first capacitor C31 is intended to stabilize off-level characteristics of an output signal Output.

Meanwhile, a bootstrap capacitor C33 may be selectively removed when a driving voltage is sufficiently high and a sufficient bootstrap for driving the third transistor T33 can happen.

Figure 10A:
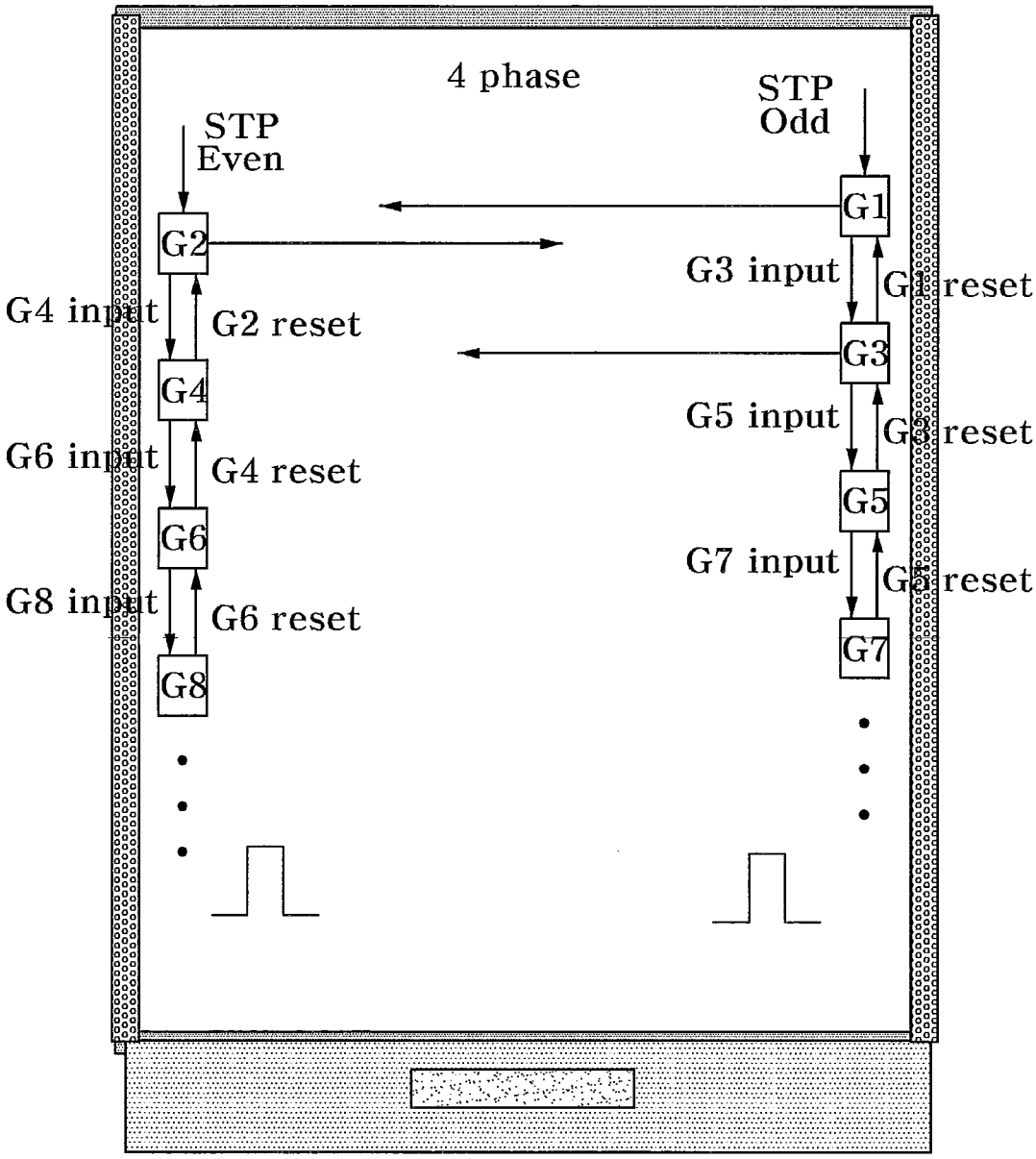
FIG. 10A is a conceptual diagram of a case in which the display driving circuits according to the first exemplary embodiment of the present invention are separately disposed on two sides of a substrate.
Figure 10B:
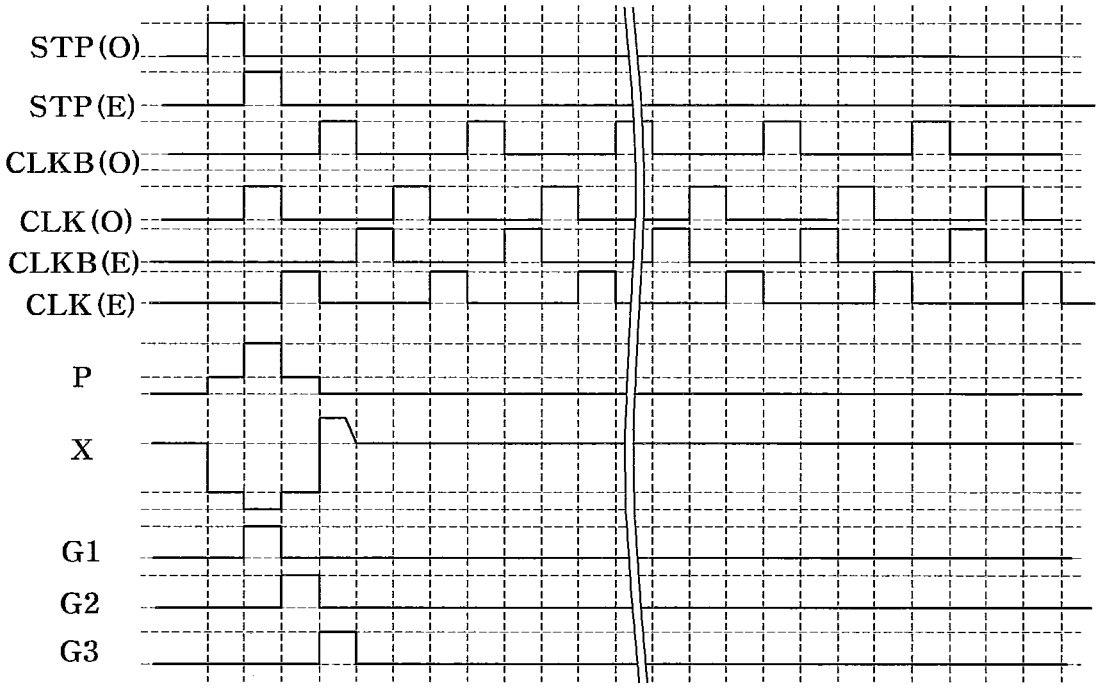
FIG. 10B is a timing diagram of FIG. 10A.

FIG. 10A is a conceptual diagram of a case in which the display driving circuits according to the first exemplary embodiment of the present invention are disposed on two sides of a substrate, and FIG. 10B is a timing diagram of FIG. 10A.

In the disposition of FIG. 10A for 4-phase driving, the display driving circuits are separately disposed (odd and even) on two sides of a substrate. Referring to FIGS. 8, 10A and 10B, among the blocks of the display driving circuits of FIG. 8, odd-numbered blocks such as a G1 block and a G3 block are disposed on the right side of the substrate, and even-numbered blocks such as a G2 block and a G4 block are disposed on the left side of the substrate.

First, an STP_O signal is input to N−1 (input) of FIG. 8, and the P-node P and the X-node X perform 4-phase driving in response to a clock signal CLK(O) and an inverted signal CLKB(O) of the clock signal CLK(O) as illustrated in the timing diagram. As a result, the G1 block outputs a gate output signal Gout(1).

Likewise, the G2 block outputs a gate output signal Gout (2) in response to an STP_E signal in the same way as the G1 block.

Meanwhile, the respective odd-numbered blocks such as the G1 block, the G3 block, and a G5 block are connected with each other, receive an input signal from the preceding blocks, and output a reset signal to the preceding blocks. This is the same for the even-numbered blocks such as the G2 block, a G4 block, and a G6 block.

For convenience, only states of the P-node and the X-node at the G1 block are illustrated in the timing diagram. Thus, timings of the P-node and the X-node are shifted by one period per block at the second block and the following blocks.

Meanwhile, in the similar disposition of FIG. 10A, only a side block connected for input and output is changed. However, the first capacitor C31, which is a bootstrap capacitor, can be removed from the block of FIG. 8. The bootstrap capacitor C33 can be selectively removed when a driving voltage is sufficiently high and a sufficient bootstrap for driving the third transistor T33 can happen.

Figure 11A:
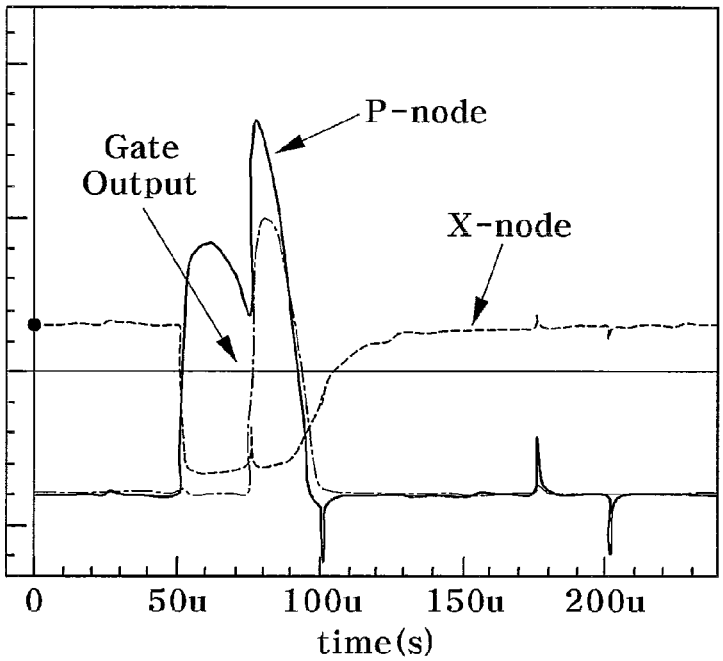
FIGS. 11A and 11B show graphs of simulation program with integrated circuit emphasis (SPICE) simulation results of a P-node, an X-node, and an output waveform according to conventional art and the first exemplary embodiment of the present invention.
Figure 11A:
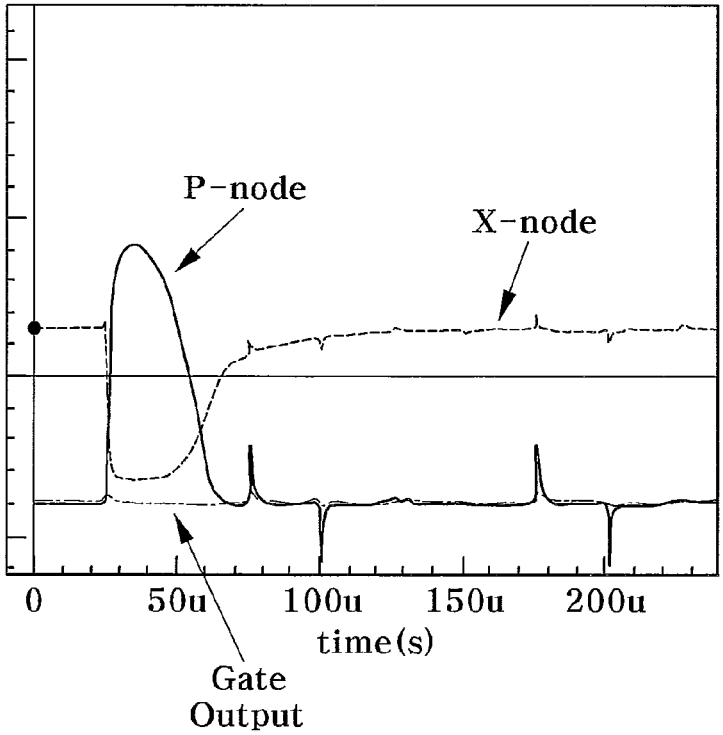
Figure 11B:
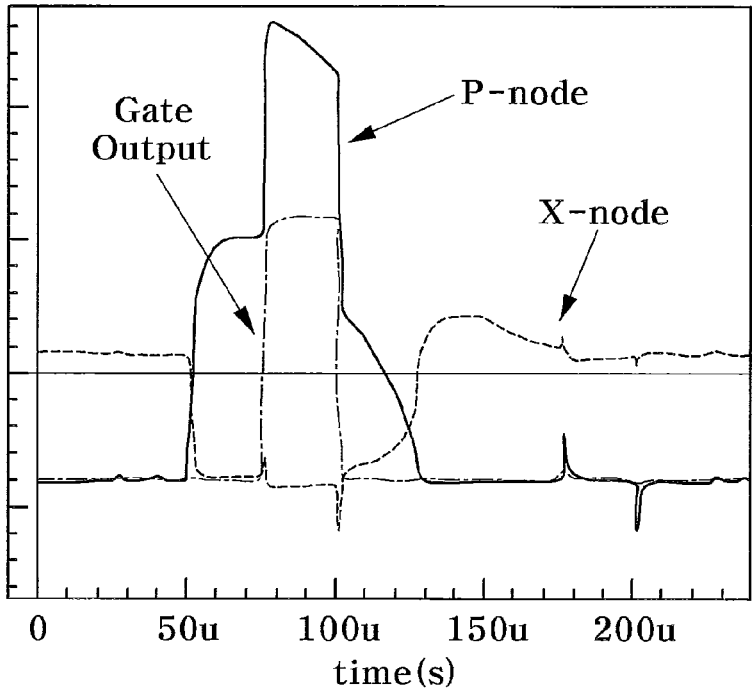
Figure 11B:
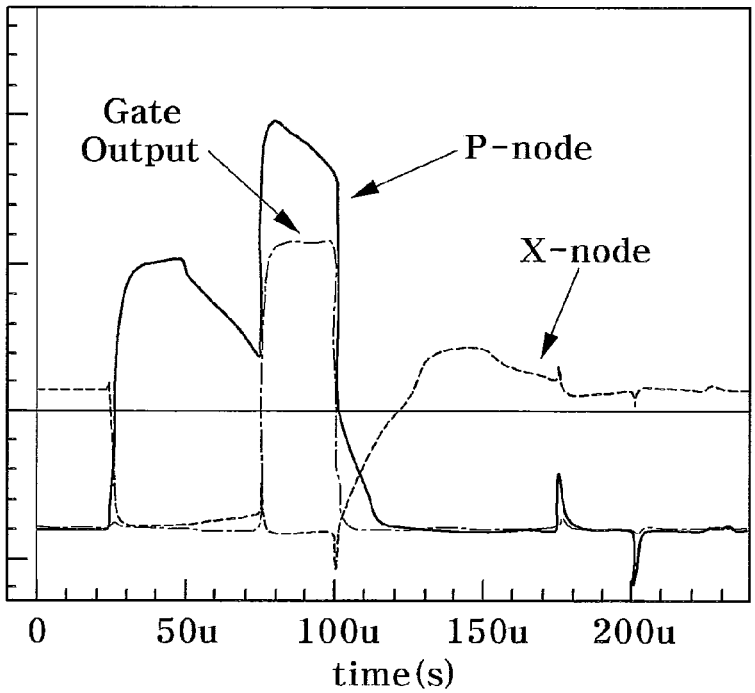

FIGS. 11A and 11B show graphs of simulation program with integrated circuit emphasis (SPICE) simulation results of a P-node, an X-node, and an output waveform according to conventional art and the first exemplary embodiment of the present invention.

Referring to FIG. 11A, when the leakage current of a transistor is large or the threshold voltage Vth is low, the floating electric potential of the bootstrap P-node collapses, and an output waveform is not normally output. However, in FIG. 11B according to the first exemplary embodiment of the present invention, the electric potential of the P-node, which is bootstrapped, is maintained as is, and a gate output waveform is stable.

<Second Exemplary Embodiment>

In a driving circuit according to a second exemplary embodiment of the present invention, a part controlling the X-node in the above-described first exemplary embodiment is shared by two stages to reduce the number of TFTs controlling the X-node, thereby effectively reducing dead space on the both sides of a display panel.

Figure 12:
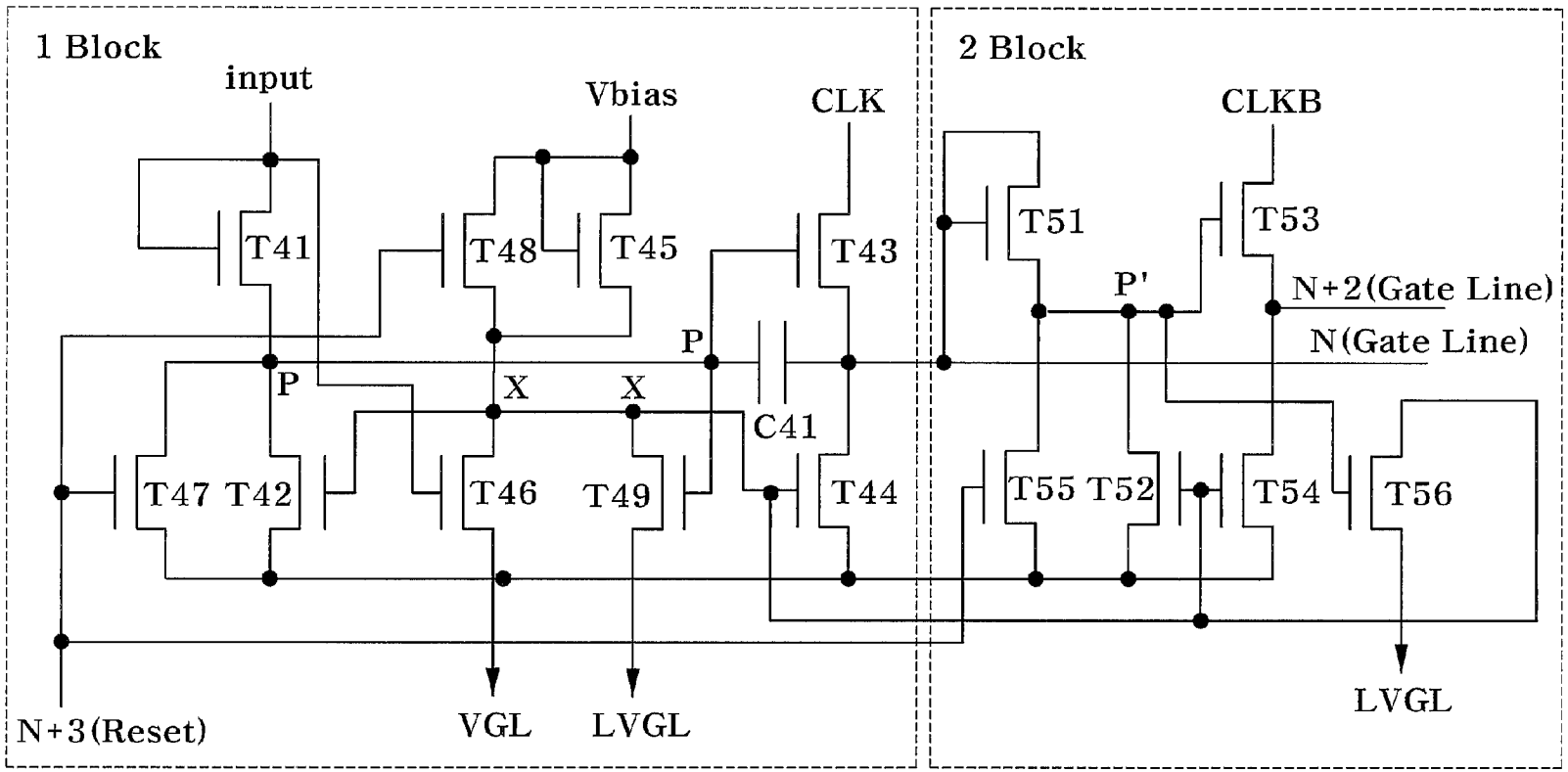
FIG. 12 is a circuit diagram of a display driving circuit according to a second exemplary embodiment of the present invention.

FIG. 12 is a circuit diagram of a display driving circuit according to a second exemplary embodiment of the present invention. In comparison with the above-described first exemplary embodiment, inverter portions of two portions outputting output waveforms are combined into one stage and used.

In this structure, a first block 1 Block and a second block 2 Block are repeatedly and successively formed on one side of a substrate, and connected in sequence to odd-numbered gate lines respectively. Also, the first block 1 Block and the second block 2 Block are repeatedly and successively formed on the opposite side of the substrate, and connected in sequence to even-numbered gate lines respectively.

It is assumed below that the first block 1 Block and the second block 2 Block are connected to an N-th gate line and an (N+2)th gate line respectively.

In the second exemplary embodiment, stages outputting two output waveforms are combined and used. Thus, it is difficult to use 2-phase driving, and basically 4-phase driving is used. Since the first block and the second block perform a reset operation using an (N+3)th output waveform, an undesired waveform may be output by 2-phase driving.

To be specific, the inverter portion of an N-th stage shift register is shared with an (N+2)th stage. The X-node in the first block is shared with the next block, and a reset is received through an (N+3)th signal, so that three TFTs controlling the voltage of the X-node can be removed. Thus, it is possible to reduce a circuit area and effectively reduce power consumption.

Figure 13A:
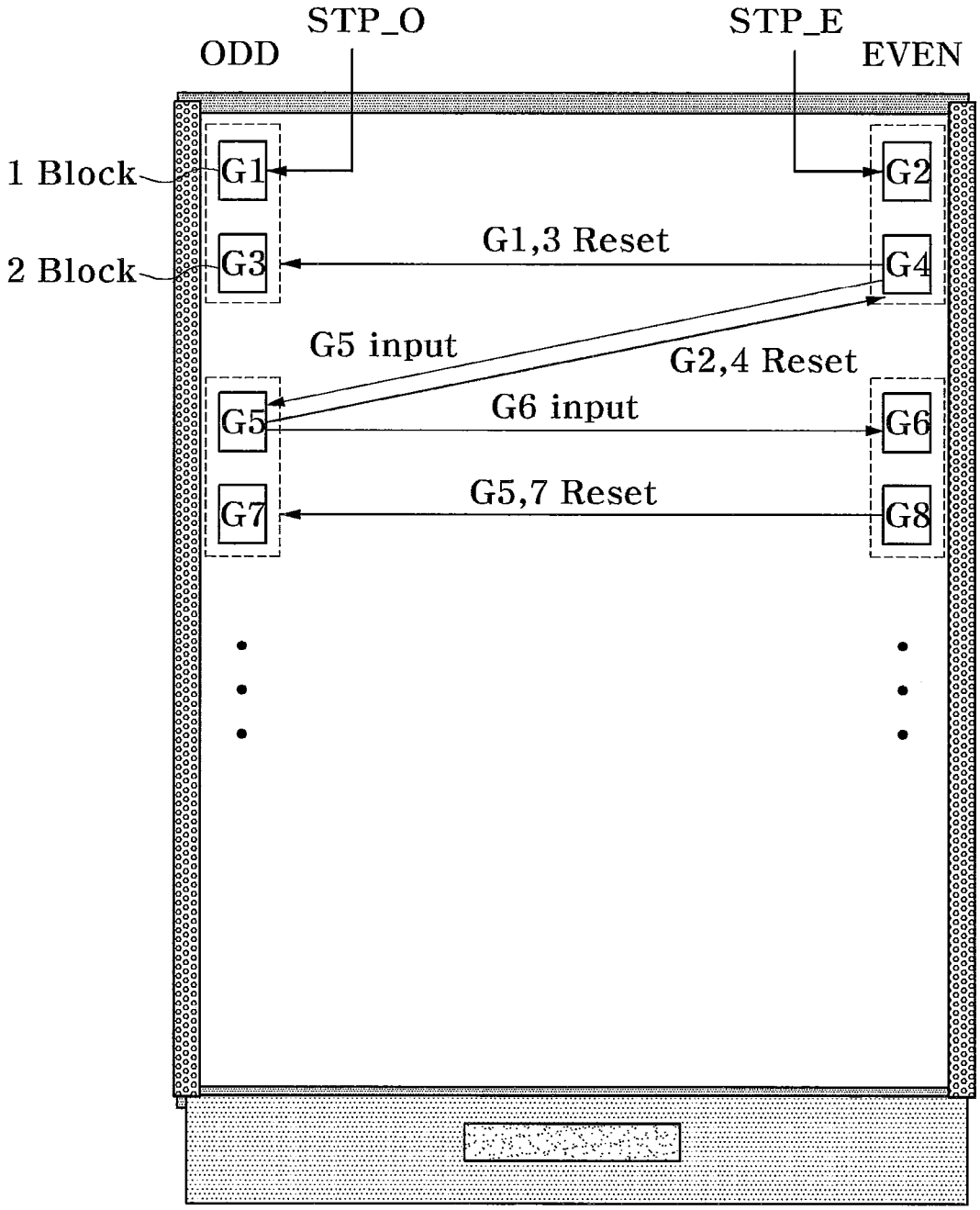
FIG. 13A is a conceptual diagram of a case in which display driving circuits are separately disposed on two sides of a substrate according to the second exemplary embodiment of the present invention.

FIG. 13A is a conceptual diagram of a case in which display driving circuits are separately disposed (odd and even) on two sides of a substrate according to an exemplary embodiment of the present invention. In FIG. 13A, the above-mentioned first and second blocks 1 Block and 2 Block of FIG. 12 can correspond to, for example, a G1 block and G3 block respectively.

Referring to FIG. 13A, the first block G1 and the second block G3 constitute one group. Such groups are disposed on the left side of a substrate and driven by an STP(O) signal, and are also disposed on the right side of the substrate and driven by an STP(E) signal.

In this constitution, two blocks constitute one group, share an X-node, and are reset at the same time. Also, after a gate output signal of a second block in one group is output, a reset signal is input later than a X-signal. For example, the gate output signal of a G4 block is input as a reset signal to the G1 and G3 blocks, and the gate output signal of a G5 block is input as a reset signal to the G2 and G4 blocks.

Also, a second block in each group (two blocks) uses a first gate output in the same block as an input signal, and a first block in each group (two blocks) uses the gate output signal of a stage preceding by one gate line as an input signal. The G5 block uses the gate output signal of the G4 block as an input signal, and a G6 block uses the gate output signal of the G5 block as an input signal.

Figure 13B:
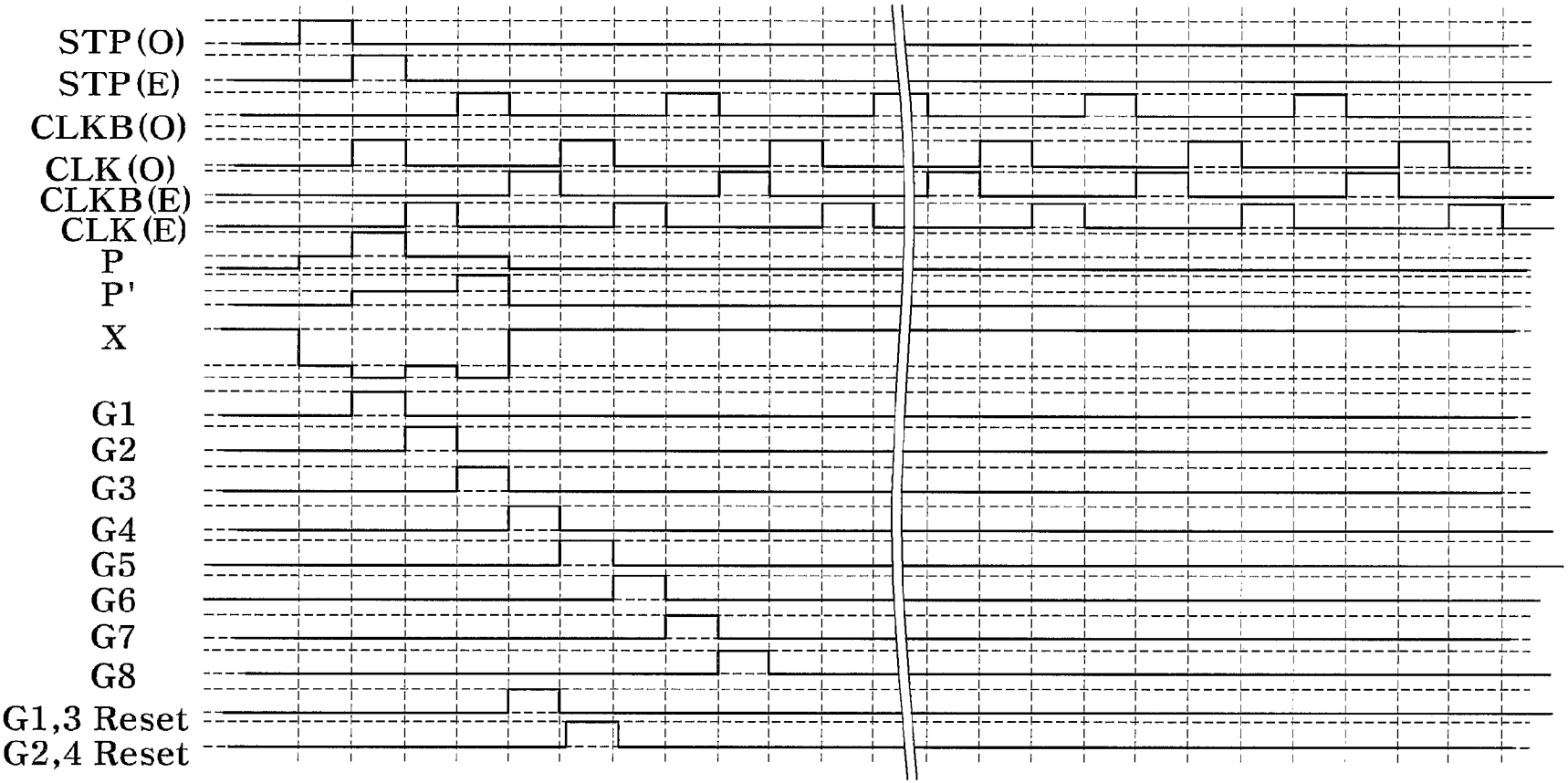
FIG. 13B is a timing diagram of FIG. 13A.

FIG. 13B shows waveform signals illustrating the display driving apparatus of FIG. 13A. The display driving apparatus will be described in detail below with reference to FIGS. 13A and 13B.

First, when the STP_O signal is input, a P-node in the G1 block is precharged. Then, a clock signal CLK(O) is switched to a high level, and a gate output signal Gout(1) is output. Subsequently, when the G3 block is precharged and an inverted clock signal CLKB(O) is switched to a high level, a gate output signal Gout(3) is output. Meanwhile, the G1 and G3 blocks are reset using a gate output signal Gout(4) as a reset signal.

When an STP_E signal is input, a P-node in the G2 block is precharged. Then, a clock signal CLK(E) is switched to a high level, and a gate output signal Gout(2) is output. Subsequently, when the G4 block is precharged and an inverted clock signal CLKB(E) is switched to a high level, a gate output signal Gout(4) is output. The G2 and G4 blocks are reset using a gate output signal Gout(5) as a reset signal.

For convenience, only states of the P-node, a P'-node and the X-node in the first block G1 are illustrated in the timing diagram. Thus, timings of the P-node and the X-node are shifted by one period per block at the second block and the following blocks.

The constitution of the first and second blocks 1 Block and 2 Block will be described in detail below.

Referring to FIG. 12, the display driving circuit according to the second exemplary embodiment of the present invention briefly includes the first block 1 Block and the second block 2 Block. The first block 1 Block includes nine TFTs T41, T42, T43, T44, T45, T46, T47, T48 and T49 and one capacitor C41, and the second block 2 Block includes six TFTs T51, T52, T53, T54, T55 and T56.

Connection of the first block 1 Block is as follows: the first, second, fourth, fifth, sixth and ninth transistors T41, T42, T44, T45, T46 and T49 have the same connection and operate in the same way as the first, second, fourth, fifth, sixth and ninth transistors T31, T32, T34, T35, T36 and T39 of the above-described first exemplary embodiment, and thus the description will not be reiterated.

The gate terminal of the third transistor T43 is connected to the P-node, the clock signal CLK is applied to the drain terminal, and the source terminal is connected to an N-th gate line.

The first capacitor C41 is connected to the gate terminal and source terminal of the third transistor T43.

Connection of the second block 2 Block is as follows: the drain terminal and gate terminal of the tenth transistor T51 are connected in common to the source terminal of the third transistor T43 of the first block 1 Block.

The drain terminal of the eleventh transistor T52 is connected with the source terminal of the tenth transistor T51 to form the P'-node, the source terminal is connected to a VGL terminal, and the gate terminal is connected with the gate terminals of the second and fourth transistors T42 and T44 of the first block 1 Block to form the X-node together.

The gate terminal of the twelfth transistor T53 is connected to the P'-node, the inverted clock signal CLKB which is the clock signal CLK shifted by two phases is applied to the drain terminal, and the source terminal is connected to the (N+2)th gate line.

The gate terminal of the thirteenth transistor T54 is connected with the gate line of the eleventh transistor T52 to form the X-node together with the gate terminals of the second and fourth transistors T42 and T44 of the first block 1 Block, the drain terminal is connected to the (N+2)th gate line, and the source terminal is connected to the VGL terminal.

The gate terminal of the fourteenth transistor T55 is connected to an (N+3)th gate line, the drain terminal is connected to the P'-node, and the source terminal is connected to the VGL terminal.

The gate terminal of the fifteenth transistor T56 is connected to the P'-node, the drain terminal is connected to the X-node, and the source terminal is connected to an LVGL terminal having a lower voltage level than the VGL terminal.

The driving circuit consisting of the first and second blocks 1 Block and 2 Block as described above may be applied to LCDs employing an a-Si TFT, but the application is not limited to the LCDs and applicable to all kinds of displays which are manufactured using Thin Film Transistor. For example, the driving circuit can be also applied to EPDs, AMOLED, and so on.

Here, an LCD and an EPD show a difference in driving voltage. For example, a basic mobile LCD has driving voltages such as Vbias of 5 V, VGL of −10 V, LVGL of −13 V and VGH of 15 V, and an EPD has driving voltages such as Vbias of 4 V, VGL of −20 V, LVGL of −24 V and VGH of 22 V. Due to the difference in driving voltages, an EPD has some superior aspects to an LCD.

To be specific, noise of an output waveform is reduced when the second and fourth transistors T42 and T44 are turned on to lower the voltages of the P-node and the output waveform to an off voltage. To this end, a difference between the high voltage of the X-node and the voltage of the VGL terminal needs to be sufficiently larger than a threshold voltage Vth so that the second and fourth transistors T42 and T44 can be driven into saturation.

The voltage of the X-node is determined by voltage distribution of the fifth, sixth and ninth transistors T45, T46 and T49 of an inverter stage. An EPD has a larger voltage difference between Vbias and VGL than an LCD, and thus a range in which the voltage of the X-node can be controlled increases.

Under a low-temperature reliability condition, the threshold voltage Vth is shifted to a positive voltage. Here, in the case of an LCD, the second and fourth transistors T42 and T44 show a waveform that cannot reach a saturation state.

On the other hand, in the case of an EPD, a sufficient voltage to overcome the threshold voltage Vth is applied by the VGL voltage, which is lower than that of an LCD. Thus, the second and fourth transistors T42 and T44 are driven with no problem and can be robust to noise of the P-node and the output waveform.

Figure 16:
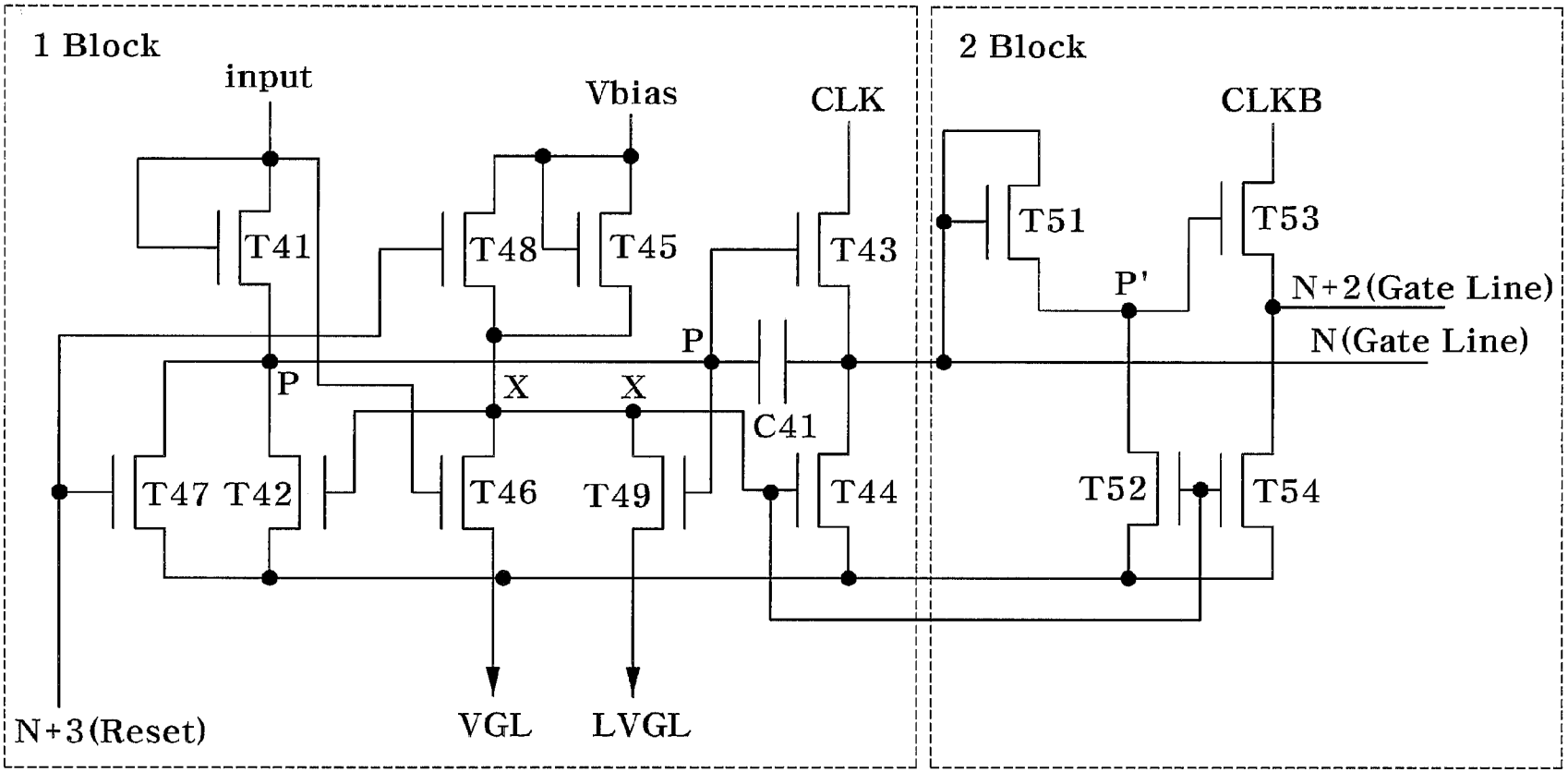
FIG. 16 is a circuit diagram of a display driving circuit according to a third exemplary embodiment of the present invention.

For this reason, the fourteenth transistor T55 and the fifteenth transistor T56 can be additionally removed from a structure to be described later according to a third exemplary embodiment of the present invention, as shown in FIG. 16. This is intended not to use a reset TFT. Here, the output waveform of a second block 2 Block may be weakened by noise, but can be maintained as close to itself as possible by the second and fourth transistors T42 and T44.

Operation of a part of the display driving circuit constituted as described above according to the second exemplary embodiment of the present invention will be described below. A case in which the first block 1 Block and the second block 2 Block are connected to an N-th gate line and an (N+2)th gate line respectively will be described as an example.

Figure 14:
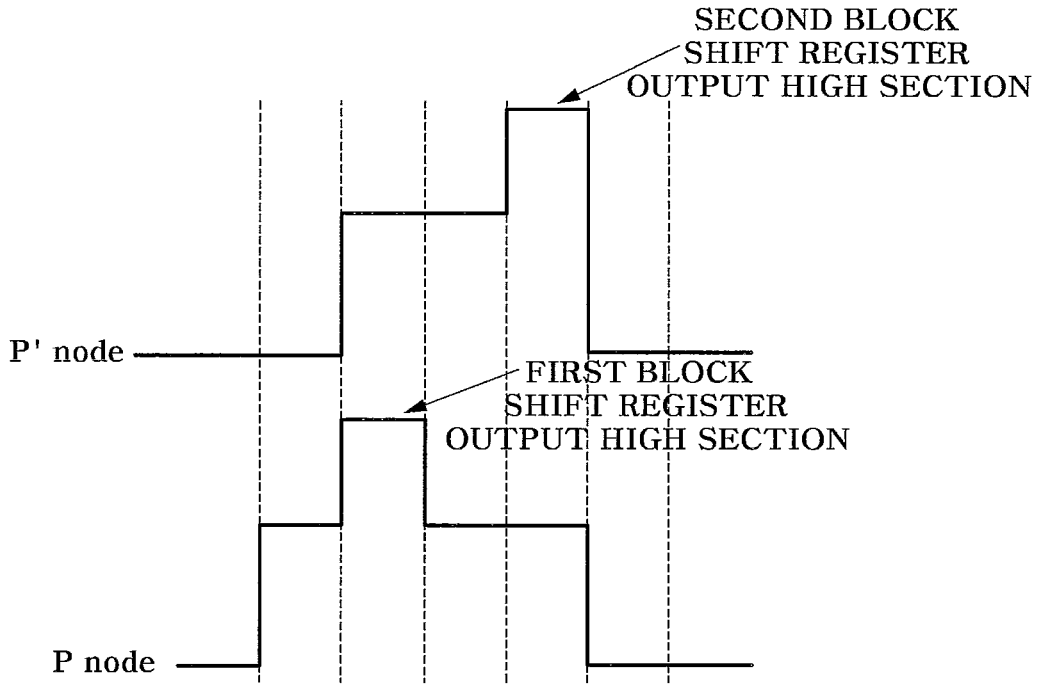
FIG. 14 shows graphs of waveforms of a P-node, P'-node, and X-node in first and second portions applied to the second exemplary embodiment of the present invention.
Figure 14:
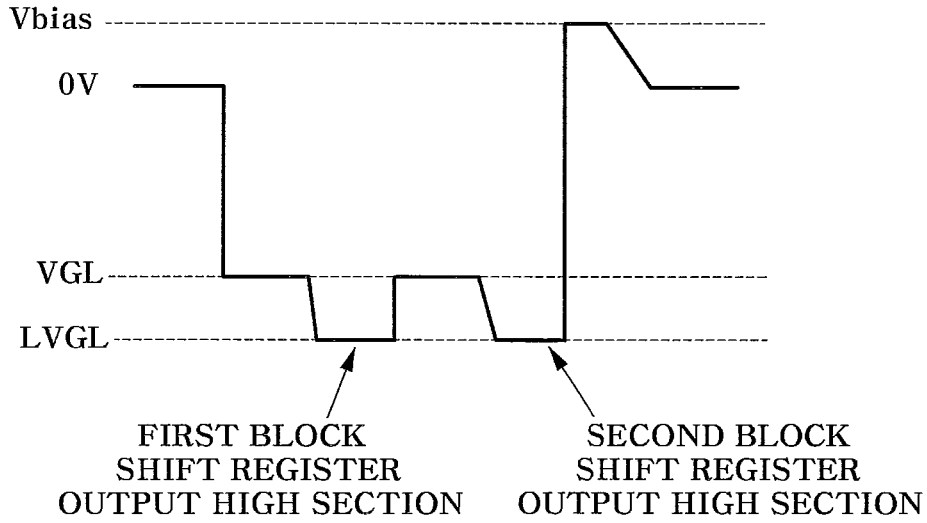

FIG. 14 shows graphs of waveforms of a P-node, P'-node, and X-node in first and second blocks applied to the second exemplary embodiment of the present invention. Basic operation of the display driving circuit according to the second exemplary embodiment is similar to that of the above-described structure according to the first exemplary embodiment. However, a reset of the first block and the second block is used as an (N+3)th output signal, and thus the low-level section of the X-node needs to be kept long as shown in FIG. 14(B).

To this end, the fifteenth transistor T56 is added to the second block 2 Block, thereby lowering the voltage of the X-node X to an LVGL level in response to a bootstrap voltage of the P'-node when a clock signal is applied to the second block 2 Block.

The driving period of a group consisting of the first and second blocks is 4 H, and the voltage of the X-node is overshot to the LVGL level during 1 H twice in response to respective clock signals. Thus, the overshoot is applied in synchronization of each clock signal during 1 H, that is, 2 H in total.

In addition to three TFTs corresponding to the transistors T45, T46 and T48 of the first block, a bootstrap capacitor corresponding to the first capacitor C41 of the first block can be removed from the second block 2 Block. Since the voltage of the X-node is maintained by the first capacitor C41 in the first block 1 Block, a bootstrap capacitor in the second block 2 Block can be removed.

However, since the output waveform of the second block 2 Block is slightly unstable, a VGL voltage needs to be lowered by about 2 V to −12 V compared to a conventional VGL voltage, and the first capacitor C41 having a slightly larger capacitance than a conventional bootstrap capacitor is used. These cause the eleventh and thirteenth transistors T52 and T54 to be placed in an operation state for sure, thereby stabilizing the output waveform.

In the second exemplary embodiment of the present invention, an input and reset are received differently than the above-described structure according to the first exemplary embodiment. The first block 1 Block receives an (N−1)th input, and the output of the first block 1 Block is received and used as the input of the second block 2 Block. Also, the reset operation is performed by the first block 1 Block and the second block 2 Block at the same time, and thus an (N+3)th output from the viewpoint of the first block 1 Block is used for reset.

Operation of the display driving circuit will be described in sequence with reference to FIGS. 12, 13A and 13B. Since operation of the first block 1 Block is the same as that of the above-described first exemplary embodiment, the description will not be reiterated. Operation of the second block 2 Block will be described in detail below.

The output signal of an N-th circuit, that is, the first block 1 Block, is input through the drain terminal of the tenth transistor T51 in the second block 2 Block. When the output signal of the N-th circuit is input through the tenth transistor T51, the clock signal CLK is also input in synchronization with the input signal.

When the input signal is in the high level VGH, the tenth transistor T51 is turned on, the P-node has a positive level, and a voltage becomes an electric potential (VGH−a) calculated by subtracting the threshold voltage of the tenth transistor T51 from the VGH voltage.

Meanwhile, an output signal is maintained at a low level because the X-node has a low level and the third transistor T43 is kept turned off. Here, the input signal is switched to the low level VGL, the tenth transistor T51 is turned off, and the twelfth transistor T53 is turned on by the high-level voltage of the P-node.

As shown in FIG. 14(A), the voltage is maintained in the floating state during the high-level time period of the clock signal CLK. When the inverted clock signal CLKB is switched to a high level, the output has a high level.

Meanwhile, the gate terminal of the fifteenth transistor T56 is connected to the P-node, and the source terminal is connected to the lower voltage level LVGL than the voltage VGL. Due to such a constitution, the X-node can maintain a low level once again as shown in FIG. 14(B).

When the output signal of an (N+3)th circuit is applied as a reset signal to the seventh transistor T47 and the eighth transistor T48 in the first block 1 Block, the P-nodes have a low level, and the X-node has high voltage due to the fifth transistor T45. Thus, the second transistor T42 and the fourth transistor T44 can be kept turned on, and it is possible to maintain the off voltage of an output waveform.

Here, a capacitance Cap of the first capacitor C41 is intended to intensify a bootstrap and maintain and stabilize an electric potential level at the X-node.

Figure 15:
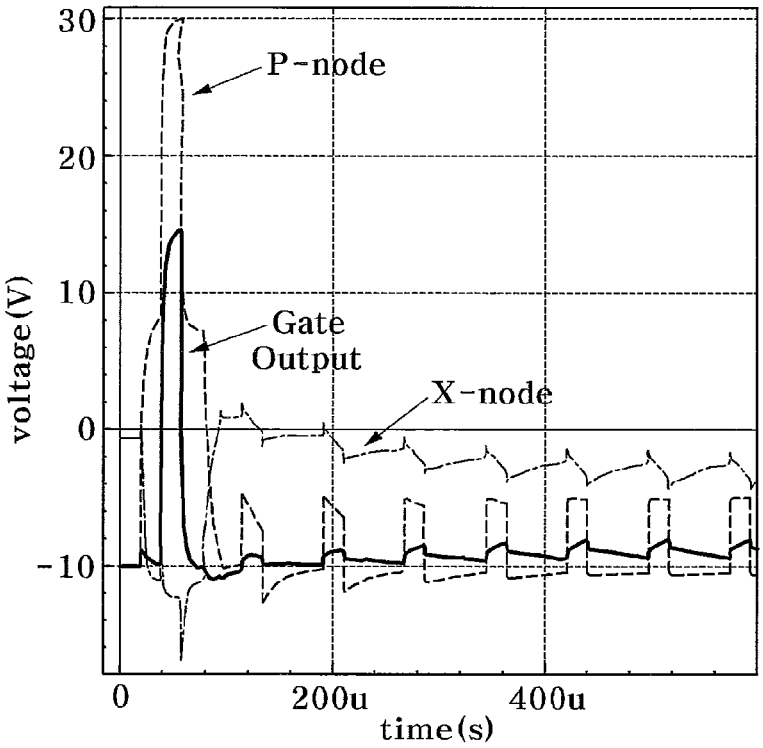
FIG. 15 shows graphs of SPICE simulation results of a P-node, an X-node, and an output waveform according to the first and second exemplary embodiments of the present invention.
Figure 15:
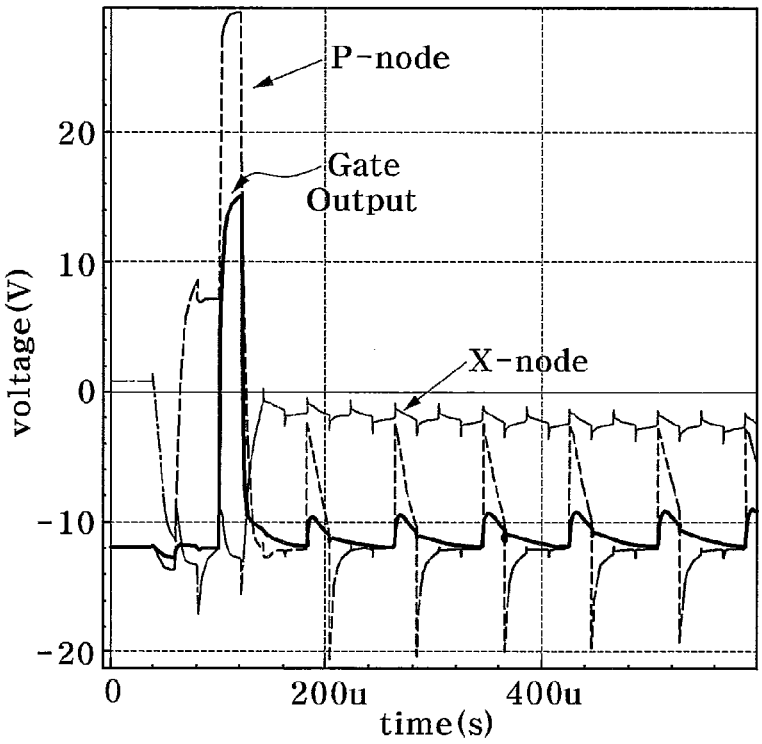

FIG. 15 shows graphs of SPICE simulation results of a P-node, an X-node, and an output waveform according to the first and second exemplary embodiments of the present invention.

In comparison with FIG. 15(A), FIG. 15(B) shows a similar output waveform. It can be seen from FIG. 15 that the second exemplary embodiment of the present invention normally operates like the above-described first exemplary embodiment.

Meanwhile, FIG. 15(A) shows the gate output waveform of the first exemplary embodiment of the present invention, and FIG. 15(B) shows the (N+2)th gate output waveform of the second exemplary embodiment of the present invention.

<Third Exemplary Embodiment>

FIG. 16 is a circuit diagram of a display driving circuit according to a third exemplary embodiment of the present invention.

Referring to FIG. 16, the display driving circuit according to the third exemplary embodiment of the present invention has the same structure as the above-described second exemplary embodiment of the present invention except the fourteenth transistor T55 and the fifteenth transistor T56 in the second block 2 Block, and thus the detailed description of the constitution and operation will not be reiterated As described above, additional removal of the fourteenth transistor T55 and the fifteenth transistor T56 in the second block 2 Block is intended not to use a reset TFT. Here, the output waveform of the second block 2 Block may be weakened by noise, but can be maintained as close to itself as possible by the second and fourth transistors T42 and T44.

Figure 17:
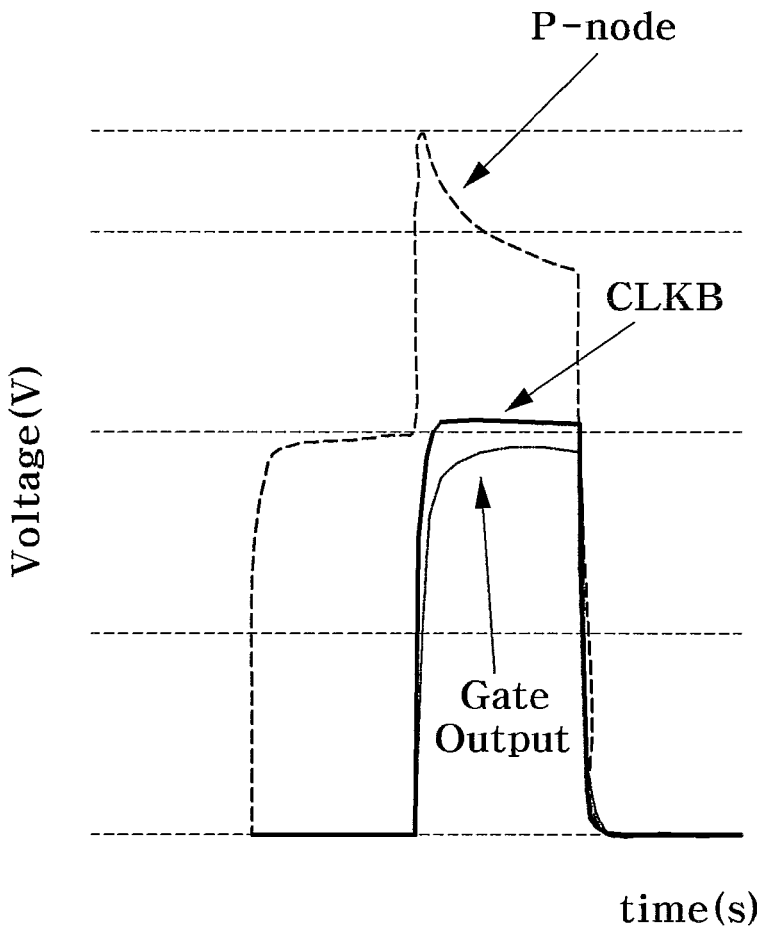
FIG. 17 shows a graph of an output waveform of the display driving circuit according to the third exemplary embodiment of the present invention.

FIG. 17 shows a graph of an output waveform of the display driving circuit according to the third exemplary embodiment of the present invention. In comparison with the above-described second exemplary embodiment, the display driving circuit according to the third exemplary embodiment has a similar output waveform.

It can be seen from FIG. 17 that the third exemplary embodiment of the present invention normally operates like the above-described second exemplary embodiment although the fourteenth transistor T55 and the fifteenth transistor T56 in the second block 2 Block are additionally removed.

The above-described display driving circuit according to an exemplary embodiment of the present invention generates the output waveform of an inverter portion applied to the gate node of a TFT in a pull-down function portion of a shift register in the form of an overshoot to reduce the bias stress voltage of the gate node, thereby increasing the life.

Further, a leakage current component is removed from the display driving circuit, and thus excellent output characteristics can be obtained without attenuation of a gate output waveform even when a TFT leakage current increasing factor, such as high temperature or low threshold voltage, occurs.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A display driving circuit, in which a gate driver including a plurality of shifter register stages for shifting and outputting an input signal is embedded, comprising:

a first transistor whose drain terminal and gate terminal are connected in common to an output terminal of an (N−1) th or (N−2)th gate line;

a second transistor whose drain terminal is connected with a source terminal of the first transistor to form a first node, and whose source terminal is connected to a VGL terminal;

a first capacitor whose first electrode receives a clock signal and whose second electrode is connected to the first node;

a third transistor whose gate terminal is connected to the first node, whose drain terminal receives an inverted signal of the clock signal, and whose source terminal is connected to an N-th gate line;

a fourth transistor whose gate terminal is connected with a gate terminal of the second transistor to form a second node, whose drain terminal is connected to the N-th gate line, and whose source terminal is connected to the VGL terminal;

a fifth transistor whose gate terminal and drain terminal are connected in common to a Vbias terminal, and whose source terminal is connected to the second node;

a sixth transistor connected between the second node and the VGL terminal, and whose gate terminal is connected to the drain terminal of the first transistor;

a second capacitor formed between the second node and the gate terminal of the sixth transistor; and a ninth transistor whose gate terminal is connected to the first node, whose drain terminal is connected to the second node, and whose source terminal is connected to an LVGL terminal having a lower voltage than the VGL terminal.

2. The display driving circuit of claim 1, further comprising:

a seventh transistor connected in parallel with the second transistor between the first node and the VGL terminal, and whose gate terminal is connected to an (N+1)th gate line; and an eighth transistor connected between the Vbias terminal and the second node, and whose gate terminal is connected to the (N+1)th gate line.

3. The display driving circuit of claim 1, wherein the voltage of the LVGL terminal is lower than that of the VGL terminal by 3 V to 6 V.

4. A display driving circuit, in which a gate driver including a plurality of shift register stages for shifting and outputting an input signal is embedded, comprising first and second blocks, wherein the first block includes:

a first input portion receiving and transferring a pulse input signal consisting of a high-level signal and a low-level signal to a first boosting node;

an inverter portion connected with the first input portion, and inverting the pulse input signal to output the inverted signal; and a first pull-up/pull-down portion consisting of a first pull-up portion connected to the first input portion, receiving a boosting voltage from the first boosting node, and outputting a first pull-up output signal, and a first pull-down portion connected to the inverter portion, receiving the inverted signal, and outputting a-s first pull-down output signal, and the second block includes:

a second input portion receiving and transferring an output signal of the first block to a second boosting node; and a second pull-up/pull-down portion consisting of a second pull-up portion receiving a boosting voltage from the second boosting node and outputting a second pull-up output signal, and a second pull-down portion sharing the inverter portion to receive the inverted signal and output a second pull-down output signal, wherein the inverter portion outputs a signal having a lower level than the low-level signal for a predetermined time period in which the pull-up output signal is output.

5. The display driving circuit of claim 4, wherein the first block and the second block are repeatedly and successively formed on one side of a substrate and connected in sequence with odd-numbered gate lines respectively, and the first block and the second block are repeatedly and successively formed on the other side of the substrate and connected in sequence with even-numbered gate lines respectively.

6. The display driving circuit of claim 4, wherein the first block and the second block are reset together.

7. The display driving circuit of claim 4, wherein the inverter portion outputs an overshoot for a predetermined time period in which the pull-down output signal is output.

8. A display driving circuit, in which a gate driver including a plurality of shift register stages for shifting and outputting an input signal is embedded, wherein the first block includes:

a first transistor whose drain terminal and gate terminal are connected in common to an output terminal of an (N−1) th gate line;

a second transistor whose drain terminal is connected with a source terminal of the first transistor to form a first node, and whose source terminal is connected to a VGL terminal;

a third transistor whose gate terminal is connected to the first node, whose drain terminal receives a clock signal, and whose source terminal is connected to an N-th gate line;

a capacitor connected to the gate terminal and the source terminal of the third transistor;

a fourth transistor whose gate terminal is connected with a gate terminal of the second transistor to form a second node, whose drain terminal is connected to the N-th gate line, and whose source terminal is connected to the VGL terminal;

a fifth transistor whose gate terminal and drain terminal are connected in common to a Vbias terminal, and whose source terminal is connected to the second node;

a sixth transistor connected between the second node and the VGL terminal, and whose gate terminal is connected to the drain terminal of the first transistor; and a ninth transistor whose gate terminal is connected to the first node, whose drain terminal is connected to the second node, and whose source terminal is connected to an LVGL terminal having a lower voltage than the VGL terminal, and the second block includes:

a tenth transistor whose drain terminal and gate terminal are connected in common to the source terminal of the third transistor in the first block;

an eleventh transistor whose drain terminal is connected with a source terminal of the tenth transistor to form a third node, whose source terminal is connected to the VGL terminal, and whose gate terminal is connected with the gate terminals of the second and fourth transistors in the first block to form the second node;

a twelfth transistor whose gate terminal is connected to the third node, whose drain terminal receives an inverted signal of the clock signal, and whose source terminal is connected to an (N+2)th gate line; and a thirteenth transistor whose gate terminal is connected with the gate terminal of the eleventh transistor and connected with the gate terminals of the second and fourth transistors in the first block to form the second node, whose drain terminal is connected to the (N+2)th gate line, and whose source terminal is connected to the VGL terminal 9. The display driving circuit of claim 8, wherein voltage of the second node is overshoot at particular period in synchronized with the clock signal and the inverted signal of the clock signal.

10. The display driving circuit of claim 8, wherein the first block further includes:

a seventh transistor connected in parallel with the second transistor between the first node and the VGL terminal, and whose gate terminal is connected to an (N+3)th gate line; and an eighth transistor connected between the Vbias terminal and the second node, and whose gate terminal is connected to the (N+1)th gate line.

11. The display driving circuit of claim 8, wherein the voltage of the LVGL terminal is lower than that of the VGL terminal by 3 V to 6 V.

12. The display driving circuit of claim 8, wherein the second block further includes:

a fourteenth transistor whose gate terminal is connected to an (N+3)th gate line, whose drain terminal is connected to the third node, and whose source terminal is connected to the VGL terminal; and a fifteenth transistor whose gate terminal is connected to the third node, whose drain terminal is connected to the second node, and whose source terminal is connected to an LVGL terminal having a lower voltage than the VGL terminal.

* * * * *

UNITED STATES PATENT AND TRADEMARK OFFICE

CERTIFICATE OF CORRECTION

PATENT NO. : 8,542,178 B2
APPLICATION NO. : 12/815942
DATED : September 24, 2013
INVENTOR(S) : Se Jong Yoo et al.

It is certified that error appears in the above-identified patent and that said Letters Patent is hereby corrected as shown below:

In the Claims

Column 14, Line 46, Claim 4, delete "a-s" and insert -- a --

Signed and Sealed this
Eleventh Day of February, 2014

Michelle K. Lee

Michelle K. Lee
*Deputy Director of the United States Patent and Trademark Office*